US007948733B2

(12) United States Patent
Hashimoto

(10) Patent No.: US 7,948,733 B2
(45) Date of Patent: May 24, 2011

(54) STATIC ELIMINATOR

(75) Inventor: Tadashi Hashimoto, Osaka (JP)

(73) Assignee: Keyence Corporation, Osaka (JP)

( * ) Notice: Subject to any disclaimer, the term of this patent is extended or adjusted under 35 U.S.C. 154(b) by 4 days.

(21) Appl. No.: 12/323,536

(22) Filed: Nov. 26, 2008

(65) Prior Publication Data

US 2009/0168288 A1 Jul. 2, 2009

(30) Foreign Application Priority Data

Dec. 28, 2007 (JP) ..... 2007-341094

(51) Int. Cl.
*H01T 23/00* (2006.01)

(52) U.S. Cl. ..... 361/230

(58) Field of Classification Search ..... 361/230
See application file for complete search history.

(56) References Cited

U.S. PATENT DOCUMENTS 4,423,462 A * 12/1983 Antonevich ..... 361/235
6,850,403 B1 * 2/2005 Gefter et al. ..... 361/230
6,979,231 B2 * 12/2005 Shinohara ..... 439/669

FOREIGN PATENT DOCUMENTS

| | | | |
|---|---|---|---|
| JP | 10-149892 | A | 6/1998 |
| JP | 2002-216995 | A | 8/2002 |
| JP | 2002-260821 | A | 9/2002 |
| JP | 2003-68498 | A | 3/2003 |

* cited by examiner

*Primary Examiner* — Jared J Fureman
*Assistant Examiner* — Ann T Hoang
(74) *Attorney, Agent, or Firm* — Smith Patent Office

(57) ABSTRACT

There is provided a static eliminator for accurately detecting a contamination condition of a discharge electrode, in which a target value as a target frame ground current value is changed from, for example, zero as a reference alternately to the plus side and the minus side to such a degree as not to affect the ion balance of a workpiece, and the follow-up time, namely a phase delay, with respect to the change in target value differs depending on the contamination condition of the discharge electrode, and becomes longer with the progress of the contamination, and by use of this characteristic, a plurality of thresholds are prepared and compared with a detected frame ground current value, so as to detect the contamination condition of the discharge electrode.

15 Claims, 26 Drawing Sheets

STATIC ELIMINATOR

CROSS-REFERENCE TO RELATED APPLICATIONS

The present application claims foreign priority based on Japanese Patent Application No. 2007-341094, filed Dec. 28, 2007, the contents of which is incorporated herein by reference.

BACKGROUND OF THE INVENTION

1. Field of the Invention

The present invention relates to a static eliminator used for eliminating static electricity of a workpiece, and more specifically relates to a static eliminator capable of accurately detecting a contamination condition of a discharge electrode included in the static eliminator.

2. Description of the Related Art

For the purpose of eliminating static electricity of a workpiece, a corona discharge type static eliminator has often been used. Typically, in a static eliminator having a long bar shape, a plurality of discharge electrodes are mounted in a longitudinally spaced condition, and a high voltage is applied to these discharge electrodes to generate an electric field between the discharge electrodes and the workpiece and thereby to apply ions to the workpiece so that static electricity of the workpiece is eliminated. However, a static eliminator disclosed in Japanese Unexamined Patent Publication No. 2002-260821 has a ground electrode (opposing electrode) plate mounted as exposed to the bottom surface of the static eliminator.

Japanese Unexamined Patent Publication No. 2003-68498 discloses that an ion current flowing between a discharge electrode and a ground electrode (opposing electrode) mounted around the discharge electrode is detected to control an amount of ion generation of a static eliminator, and when the amount of ion generation decreases, an operator's attention is drawn by a display device or an alarm device, indicating the progress of contamination of the discharge electrode.

SUMMARY OF THE INVENTION

In a case where contamination of the discharge electrode is detected by means of the ion current between the discharge electrode and the ground electrode (opposing electrode) around the discharge electrode, for example when a capacious workpiece is present in the vicinity of the static eliminator, the ion current flowing between the discharge electrode and the ground electrode decreases owing to this workpiece, which might cause improper detection that the amount of ion generation has decreased despite a sufficient amount of ion being generated by the discharge electrode, thereby resulting in determination that the contamination condition of the discharge electrode has progressed.

An object of the present invention is to provide a static eliminator capable of accurately detecting a contamination condition of a discharge electrode.

According to a first aspect of the present invention, the above-mentioned technical object is achieved by providing a static eliminator, which applies a high voltage to a discharge electrode to generate ions so as to eliminate static electricity of a workpiece, the eliminator having: an ion current detection device which detects an ion current between a discharge electrode and a frame ground; an ion generation control device which adjusts a voltage to be applied to the discharge electrode such that the ion current detected by the ion current detection device is a prescribed ion balance target value; a target value change device which changes the ion balance target value to a target value offset to such a degree as not to affect the ion balance of the workpiece; and an electrode contamination detection device which detects contamination of the discharge electrode in accordance with the quality of follow-up performance of the control when the ion balance target value is changed by the target value change device.

According to a second aspect of the present invention, the above-mentioned technical object is achieved by providing a static eliminator, which applies a high voltage to a discharge electrode to generate ions so as to eliminate static electricity of a workpiece, the eliminator having: an ion current detection device which detects an ion current between a discharge electrode and a ground electrode in the vicinity of the discharge electrode; an ion generation control device which adjusts a voltage to be applied to the discharge electrode such that the ion current detected by the ion current detection device is a prescribed ion balance target value; a target value change device which changes the ion balance target value to a target value offset to such a degree as not to affect the ion balance of the workpiece; and an electrode contamination detection device which detects contamination of the discharge electrode in accordance with the quality of follow-up performance of the control when the ion balance target value is changed by the target value change device.

When the ion balance target value is changed, the follow-up performance of the control varies depending on a contamination condition of the discharge electrode. The more the contamination of the discharge electrode has progressed, the poorer the follow-up performance is. Through the use of this characteristic, the ion balance target value is changed to such a degree as not to affect the ion balance of the workpiece, so that the contamination condition of the discharge electrode can be accurately detected in accordance with the quality of the follow-up performance of the control associated with the change in target value.

The above objects, the other objects, and the working effect of the present invention will become apparent from the following detailed description of preferred embodiments of the present invention.

DETAILED DESCRIPTION OF THE PREFERRED EMBODIMENTS

Figure 1:
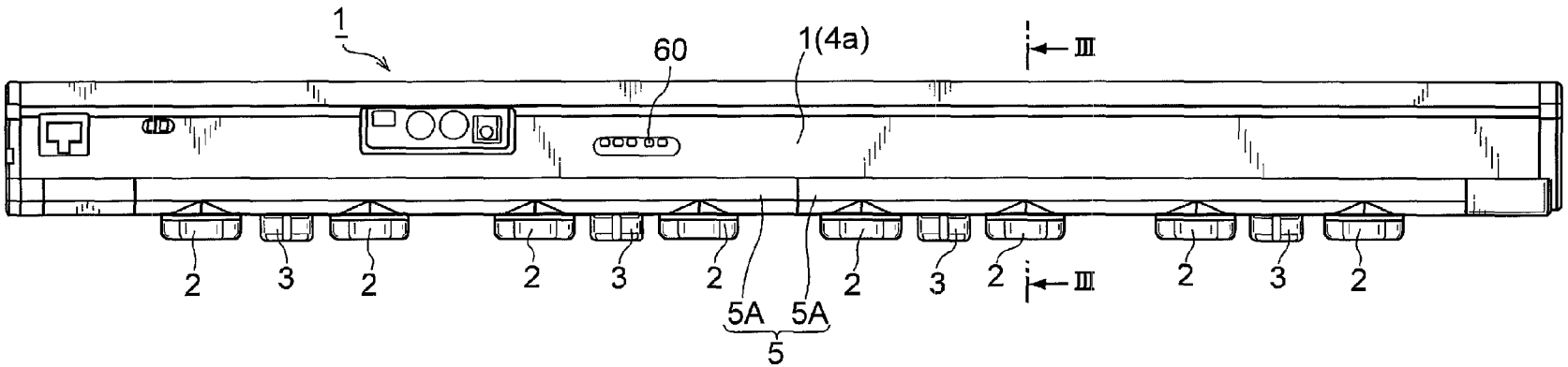
FIG. 1 is a side view of a static eliminator of an embodiment.

An embodiment of the present invention will be described in detail below with reference to the accompanying drawings. FIG. 1 is a side view of a static eliminator of the embodiment. In a static eliminator 1, eight main discharge electrode units 2 and four additional discharge electrode units 3 are mounted in a plurality of number in a longitudinally spaced condition on the bottom surface of a case 1*a* with a long external outline. It is to be noted that the four additional discharge electrode units 3 are attached and detached according to the user's option, and the configuration of this additional discharge electrode unit 3 is approximately equal to a basic configuration of the main discharge electrode unit 2. The difference between the main discharge electrode unit 2 and the additional discharge electrode unit 3 will be described later.

Figure 2:
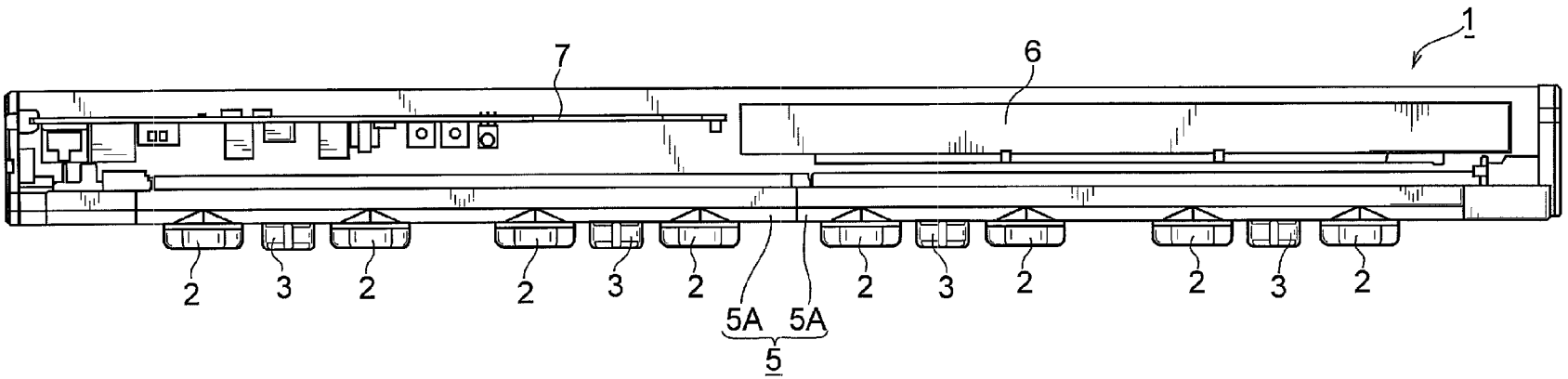
FIG. 2 is a side view showing the static eliminator of the embodiment with an outer case removed therefrom.
Figure 3:
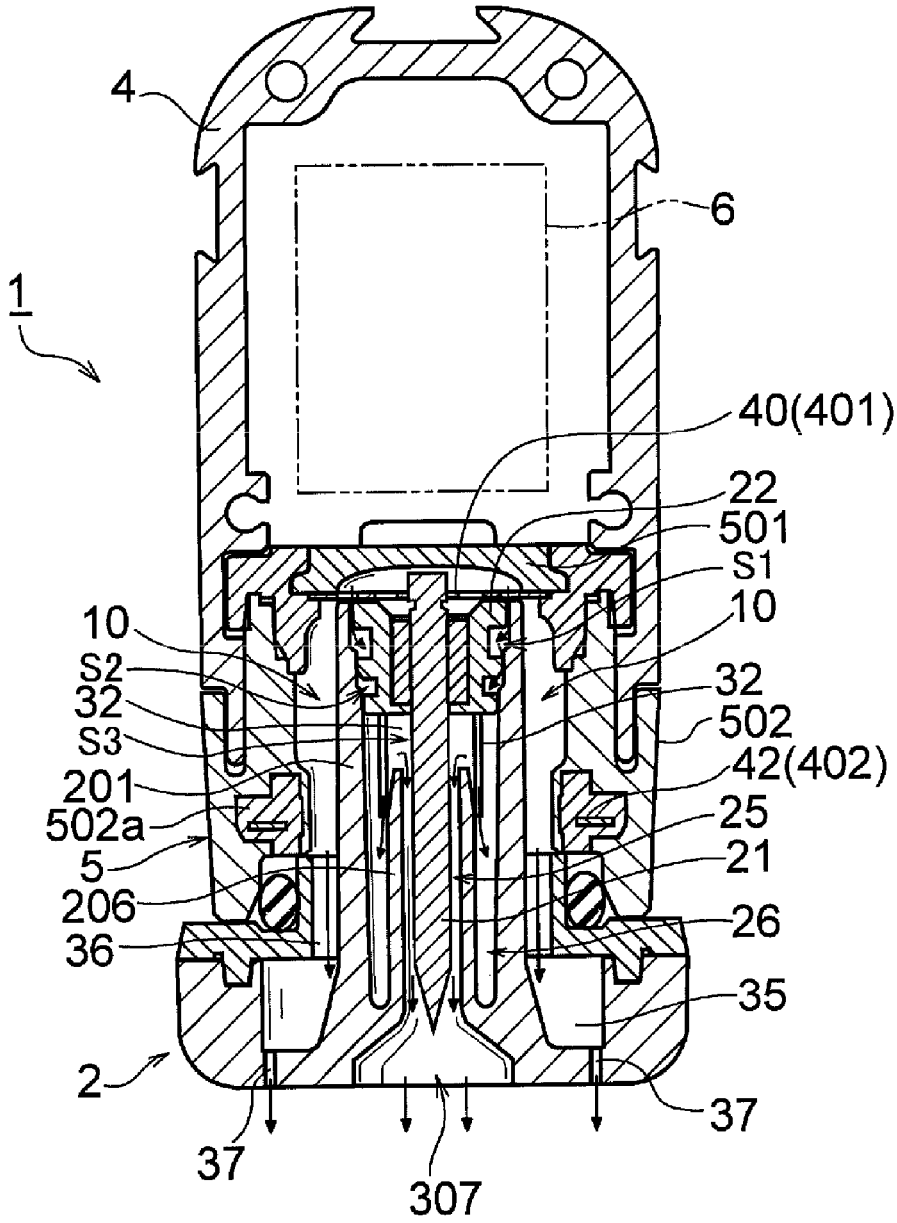
FIG. 3 is a cross sectional view along line III-III of FIG. 1.

The outer case 4 for covering the upper half of the static eliminator 1 has a closed-top open-end cross-sectionally inverted U shape with its top closed and its bottom open (FIG. 3), and is detachable from a base 5 constituting the lower portion of the external boarder of the lower external outline of the static eliminator 1. FIG. 2 shows the static eliminator 1 in a state where the outer case 4 has been removed. FIG. 3 is a sectional view along line III-III of FIG. 1. With reference to FIG. 2, in the static eliminator 1, a high voltage unit 6 and a control substrate 7 including, for example, a display circuit and a CPU are mounted in the upper region surrounded by the outer case 4.

Figure 16:
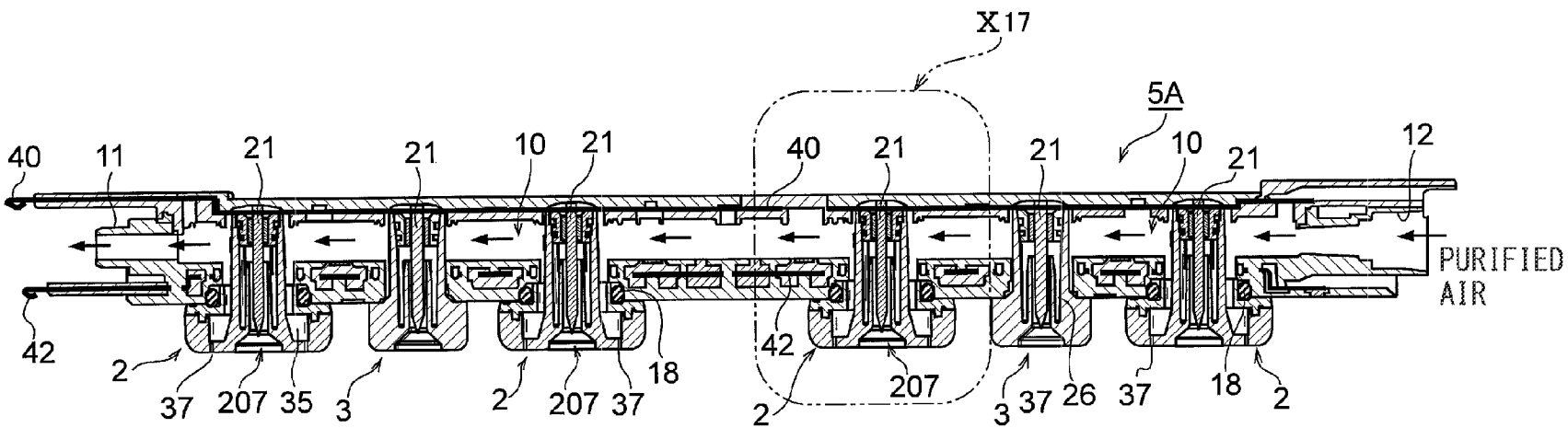
FIG. 16 is a sectional view of the half base.

The base 5 constituting the lower portion of the static eliminator 1 is formed by mutual connection of two half bases 5A, 5A with substantially the same configuration along the longitudinal direction of the static eliminator 1. On each half base 5A, four main discharge electrode units 2 and two additional discharge electrode units 3 are mountable, and as understood from FIG. 3, a plurality of insulating synthetic resin members are combined, to form an internal gas channel 10 having a closed cross-section with its top, bottom, right and left sides closed. This internal gas channel 10 continuously extends in the longitudinal direction of each half base 5A as shown in FIG. 16.

Figure 4:
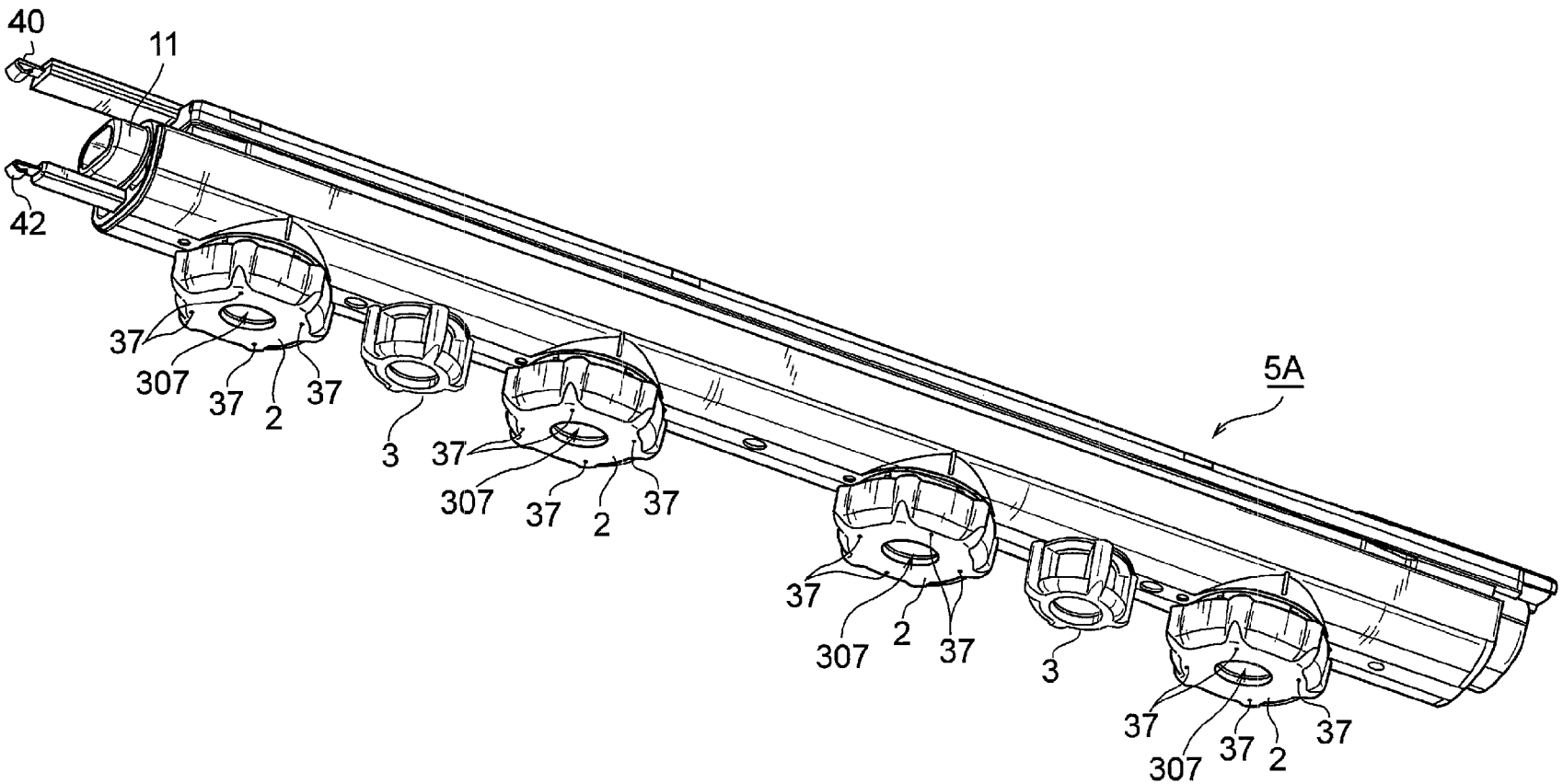
FIG. 4 is a perspective view of a half base constituting the half of a base of the static eliminator.

FIG. 4 is a perspective view of the half base 5A. The half base 5A is shown in the figure in a state where the main discharge electrode units 2 and the additional discharge electrode units 3 have been built therein. The one end (the left end of the top in the figure) of the half base 5A has a projected gas channel connecting port 11, and a depressed gas connecting port 12 (see later-described FIG. 16) to accept this gas channel connecting port 11 is formed at the other end (the right end in FIG. 4) of the half base 5A. The mutually adjacent two half bases 5A, 5A form the continuous internal gas channel 10 of the static eliminator 1 by engaging of the projected gas channel connecting port 11 of the one half base 5A with the depressed gas connecting port of the other half base 5A.

Figure 5:
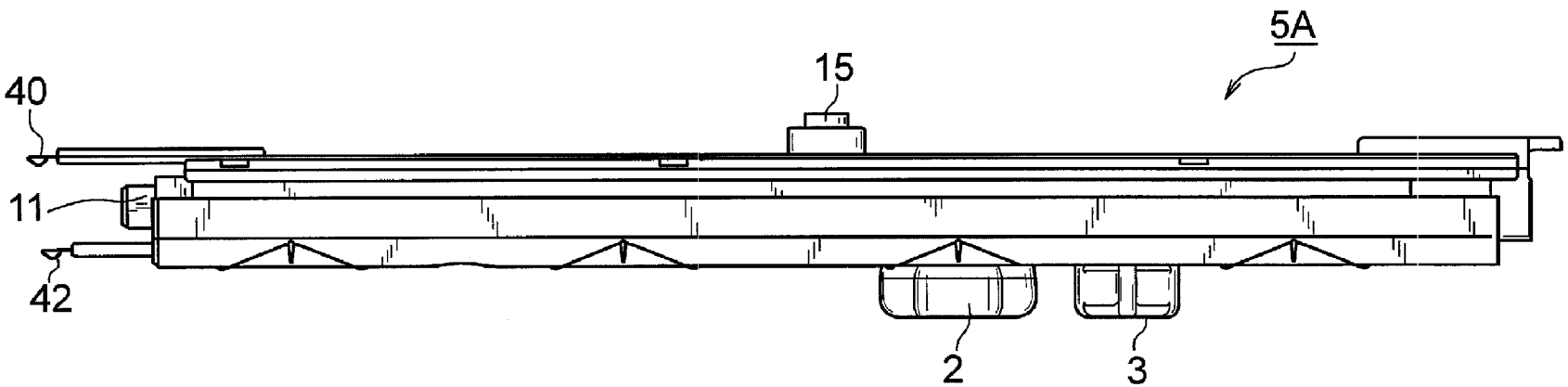
FIG. 5 is a side view of the half base.
Figure 6:
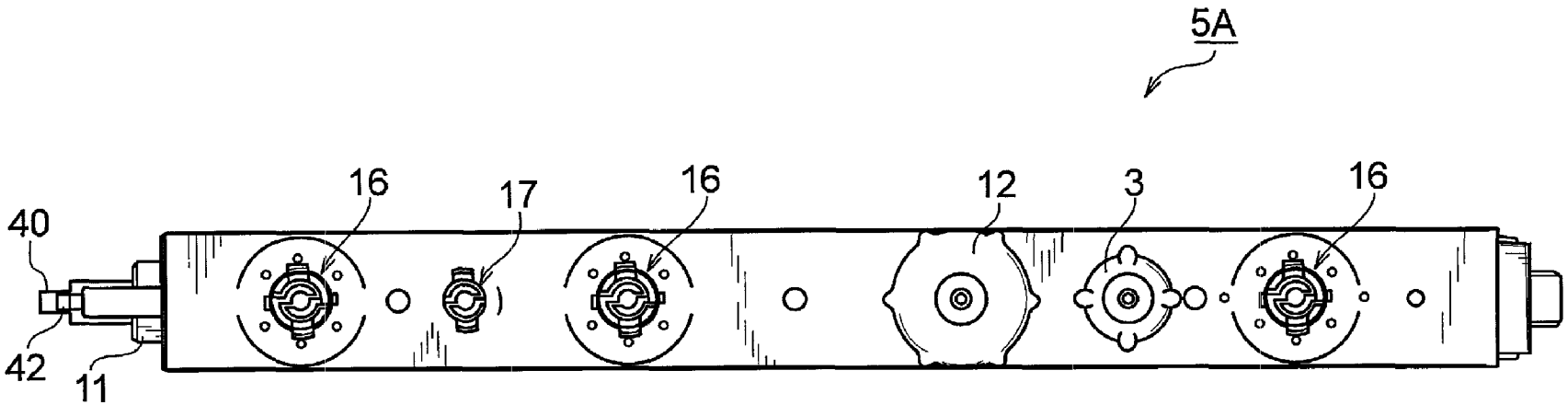
FIG. 6 is a bottom view of the half base.
Figure 7:
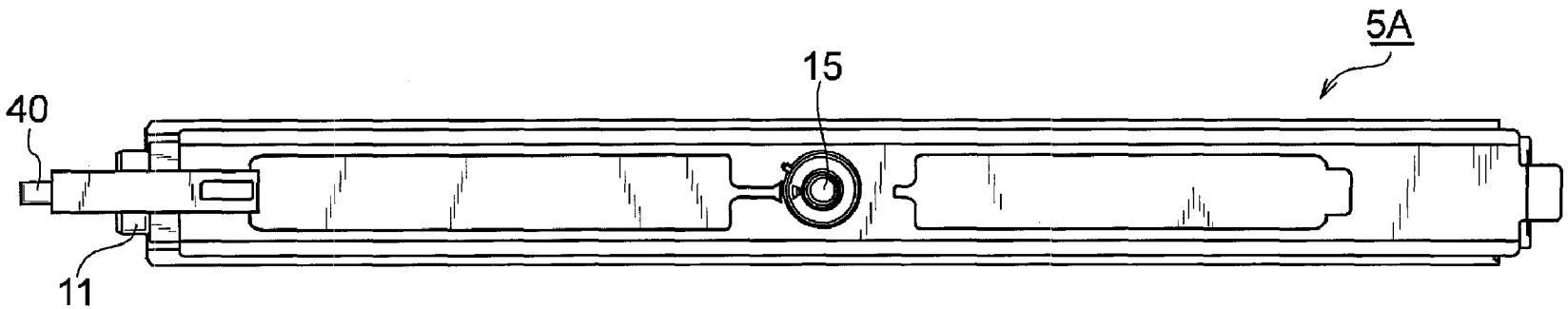
FIG. 7 is a plan view of the half base.

FIG. 5 is a side view of the half base 5A. FIG. 6 is a bottom view of the half base 5A. FIG. 7 is a plan view of the half base 5A. It is to be noted that these half base 5A are shown in FIGS. 5 to 7 in a state where one main discharge electrode unit 2 and one additional discharge electrode unit 3 have been mounted thereon.

As seen from FIGS. 5 to 7, a connector 15 is provided upward in a protruding condition in the longitudinal central portion of the top surface of the half base 5A, and through this connector 15, a high voltage generated in the high voltage unit 6 is supplied to the half base 5A. More specifically, the outer circumferential section of this connector 15 is formed of an insulating resin, and the inner section thereof is provided with a cylindrical female connector, not shown, which is opened toward the top of the connector. The other end of this female connector is connected to a distribution plate 40 provided under the connector 15. The open-end of this female connector is connected with a male connector (not shown) extending from the high voltage unit 6 provided inside the outer case, and a high voltage is supplied to the distribution plate 40. In addition, since only one high voltage unit 6 is provided in one static eliminator 1 even when the length of the static eliminator 1 changes, one connector 15 is practically used in one static eliminator.

On the bottom surface of the half base 5A formed are main unit accepting ports 16 each for accepting the main discharge electrode unit 2 and additional unit accepting ports 17 each for accepting the additional discharge electrode unit 3. Specifically, one additional discharge electrode unit 3 is provided at least in an approximately central position between a pair of main discharge electrode units 2, 2 provided in the respective half bases and on the straight line connecting the main discharge electrode unit 2, 2.

It should be noted that the static eliminator 1 having the additional discharge electrode unit 3 between the pair of main discharge electrode units 2, 2 is effective, considering the static elimination time and the like, for a target for static elimination and a static elimination line with which static elimination is performed at a lower speed than a desired value by using only an amount of ion generated from the main discharge electrode unit 2 provided in the static eliminator 1.

The main discharge electrode unit 2 and the additional discharge electrode unit 3 are detachably mounted in the respective ports 16, 17 through sealing ring 18 (FIG. 17) by a later-described method. It should be noted that in the case of omitting mounting of the additional discharge electrode unit 3, a sealing member (not shown) for sealing the additional unit accepting port 17 is detachably mounted on the additional unit accepting port 17.

Figure 8:
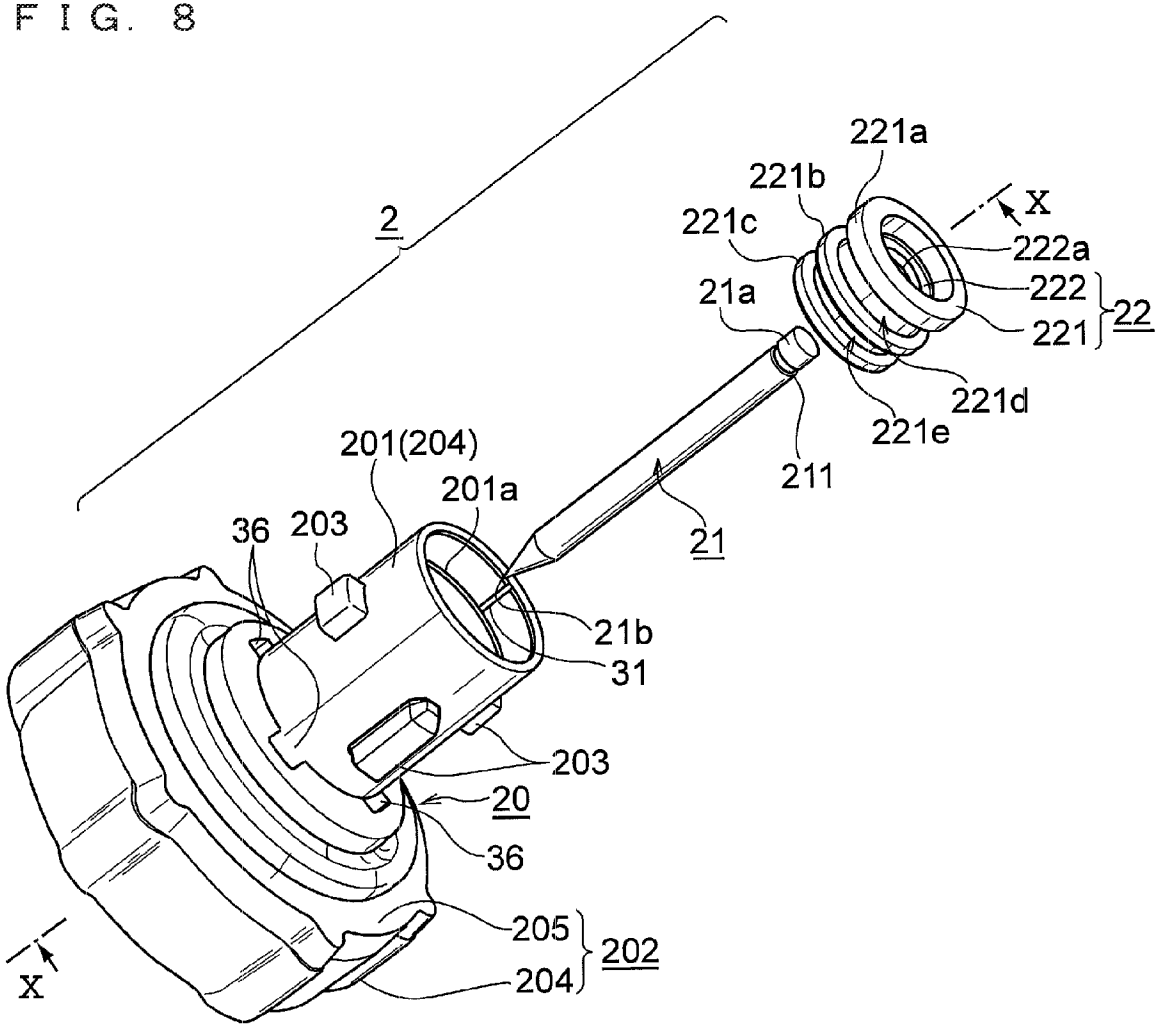
FIG. 8 is an exploded perspective view of a discharge electrode unit.

FIG. 8 is an exploded perspective view of the main discharge electrode unit 2. The main discharge electrode unit 2 is made up of a unit body 20 made of an insulating synthetic resin, the discharge electrode 21, and a discharge electrode holding member 22. The discharge electrode 21 includes a base end 21*a* provided with a circumferential groove 211 and a pointed leading end 21*b*, but the shape of the leading end 2*b* is arbitrarily formed.

Figure 9:
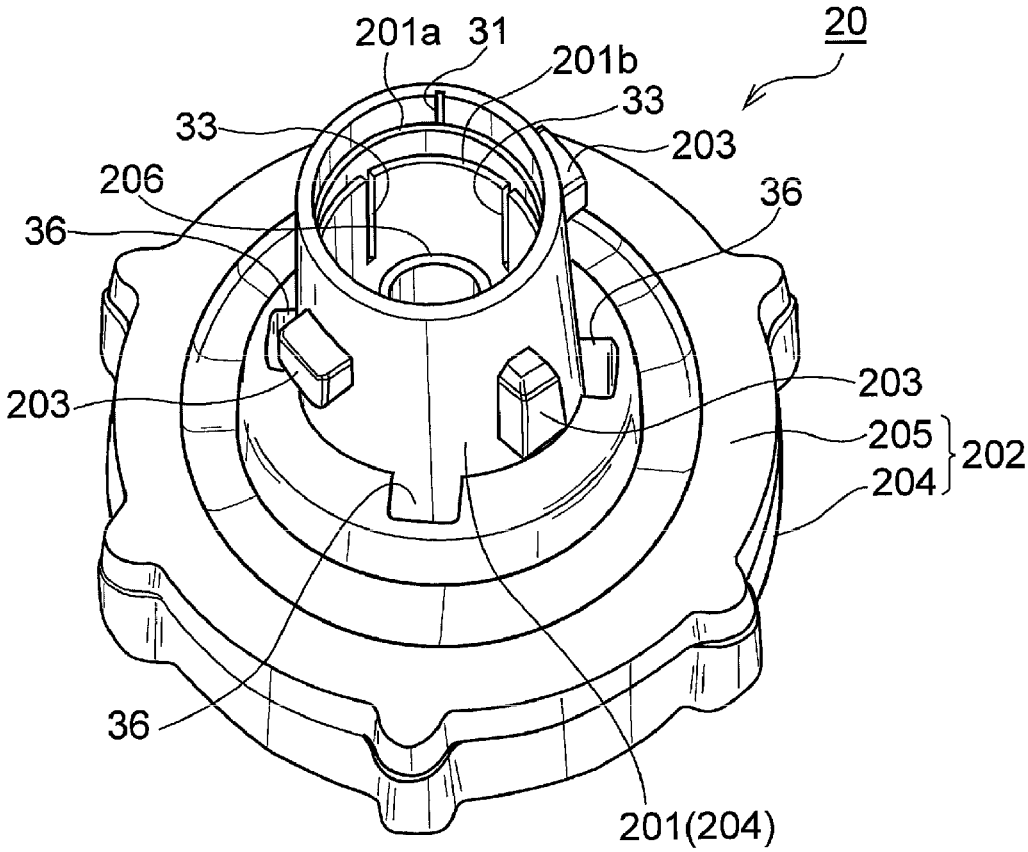
FIG. 9 is a perspective view of a unit body of the discharge electrode unit seen from the diagonally upper side thereof.

FIG. 9 is a perspective view of the unit body 20 seen from the diagonally upper side thereof. With reference to FIGS. 8 and 9, the unit body 20 has an outside cylindrical wall 201 and an expanded head section 202, and on the outer circumferential surface of the outside cylindrical wall 201, a plurality of projections 203 are formed in a mutually circumferentially spaced condition. With these projections 203, the main discharge electrode unit 2 can be engaged into the main unit accepting port 16 of the base 5, so as to be detachably mounted onto the base 5. Specifically, a projecting section into which the projection 203 is engaged is formed in the main unit accepting port 16, and the projection 203 is brought into the state of being engaged in the main unit accepting port 16 when the main discharge electrode unit 2 is inserted into the main unit accepting port 16 and circumferentially rotated by a prescribed angle, and the main discharge electrode unit 2 can be detached from the main unit accepting port 16 when rotated in the reversed direction. Since such a detachable mounting method is conventionally known, a detailed description thereof is not given.

Figure 10:
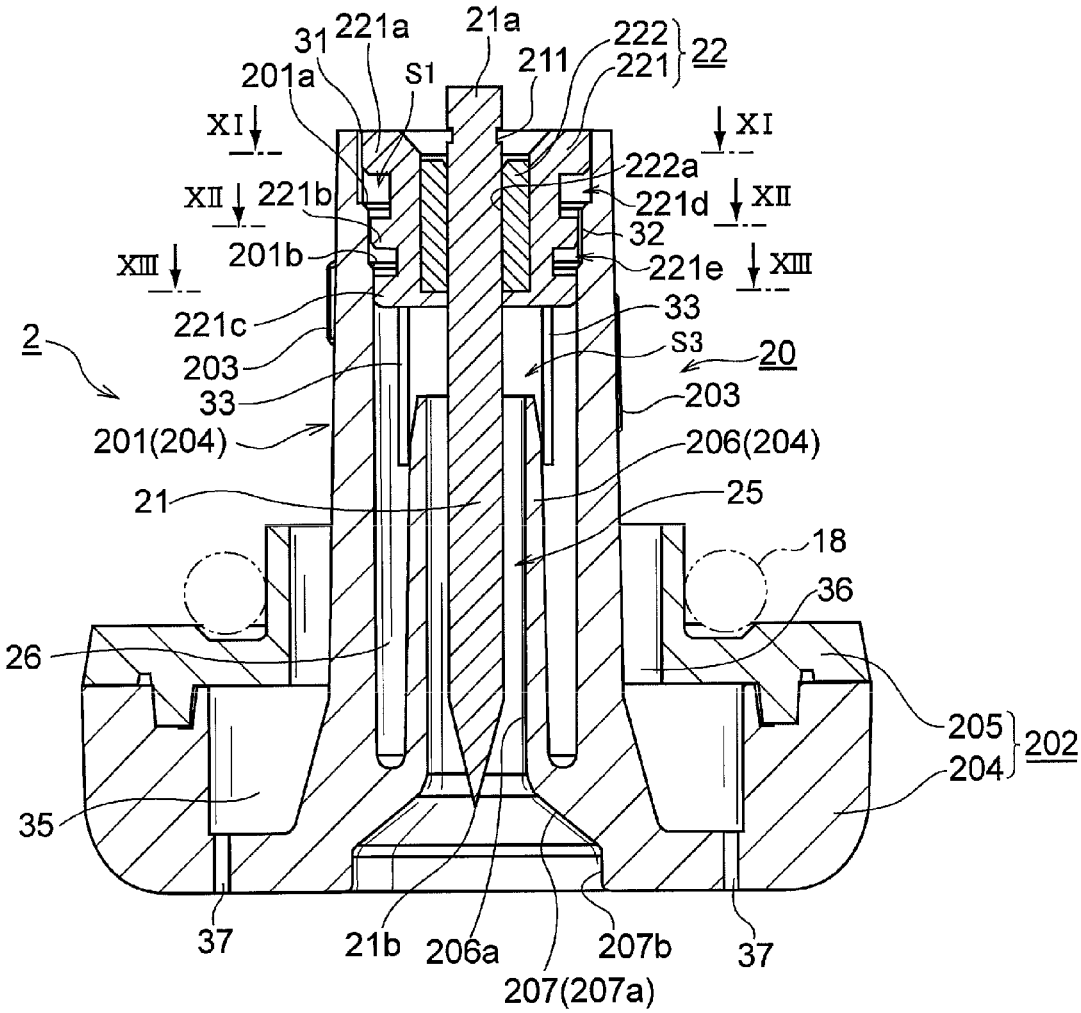
FIG. 10 is a sectional view of the discharge electrode unit along line X-X of FIG. 8.
Figure 11:
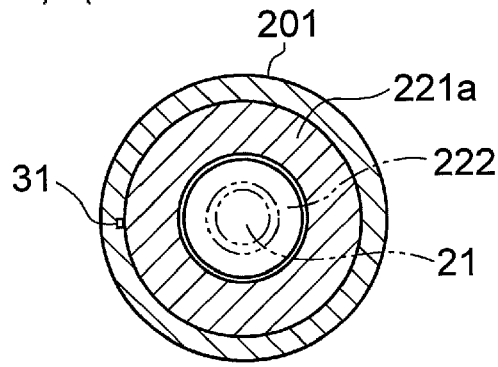
FIG. 11 is a sectional view along line XI-XI of FIG. 10.

FIG. 10 is a sectional view of the main discharge electrode unit 2 along line X-X of FIG. 8. As seen from FIG. 10, the unit body 20 is formed by attachment of a main member 204 and an auxiliary member 205 which were both made of an insulating resin material.

Continuously with reference to FIG. 10, the unit body 20 has an inside cylindrical wall 206 spaced inward in the diametrical direction of the outside cylindrical wall 201. The inside cylindrical wall 206 and the outside cylindrical wall 201 are concentrically disposed, and the shaft center is provided with the discharge electrode 21. The inside cylindrical wall 206 has a central long hole 206*a* having a cross-sectionally circular shape concentric with the inside cylindrical wall 206. In the inside cylindrical wall 206, the top of the central long hole 206*a* is opened and the bottom thereof is opened to the outside through the expanded head section 202. Numeral 207 denotes this opening section of the expanded head section 202. The central opening section 207 has a taper surface 207*a* with its diameter expanded downward, and this taper surface 207*a* is continued to a cylindrical surface 207*b* of the bottom (opening end) of the central opening section 207. Meanwhile, the top of the inside cylindrical wall 206 is opened so as to face a circumferential chamber S3 formed between the later-described discharge electrode holding member 22 and the inside cylindrical wall 206. In other words, the inside cylindrical wall 206 is positioned inside the main discharge electrode unit 2, and formed in the range surrounding part of the discharge electrode 21, except for a portion supported by the discharge electrode holding member 22, from the leading end 21*b* of the discharge electrode 21 toward the discharge electrode holding member 22.

The leading end 21*b* of the discharge electrode 21 is positioned so as to slightly project from the central long hole 206*a* to the taper surface 207*a*. As seen from FIG. 10, the discharge electrode 21 is mounted concentrically with the center line of the central long hole 206*a*, namely the shaft line of the inside cylindrical wall 206, and the outer circumferential surface of the discharge electrode 21 and the inner circumferential surface of the inside cylindrical wall 206 are in a mutually spaced state. Here, the inner diameter of the inside cylindrical wall 206 is uniform in the shaft line direction, and is larger than the outer diameter of the discharge electrode 21. It is to be noted that the discharge electrode 21 has the uniform outer dimensions over almost the full length thereof except for its leading end.

The top of the inside cylindrical wall 206 is located in the longitudinally intermediate portion of the discharge electrode 21. A cylindrical gas outflow channel 25 for shielding, which is circumferentially continued over the full length of the inside cylindrical wall 206, is formed between the inside cylindrical wall 206 and the discharge electrode 21. Further, the bottom of the inside cylindrical wall 206 is penetrated down to the expanded head section 202. More specifically, the bottom of the inside cylindrical wall 206 is located in the vicinity of a position as high as the bottom of the central long hole 206*a*.

A first gas pool 26 is formed between the inside cylindrical wall 206 and the outside cylindrical wall 201 concentric with the inside cylindrical wall 206. The bottom of this first gas pool 26 is penetrated down to the expanded head section 202. Specifically, the first gas pool 26 is mounted in a relation such that a section of the discharge electrode 21 from its longitudinally intermediate portion up to the vicinity of the leading end 21*b* diametrically overlaps the gas outflow channel 25 for shielding which extends along the circumferential surface of the discharge electrode 21. More specifically, the first gas pool 26 with the inside cylindrical wall 206 functioning as a partition wall is disposed around the gas outflow channel 25 for shielding which extends from the longitudinally central portion of the discharge electrode 21 to the leading end thereof along the circumferential surface of the discharge electrode 21, and this first gas pool 26 is circumferentially continued as well as longitudinally continued. Further, the one end of the first gas pool 26 faces the circumferential chamber S3, and is connected to the gas outflow channel 25 for shielding, which is formed inside the inside cylindrical wall 206, through the circumferential chamber S3. In other words, the one end of the first gas pool 26 made open to the circumferential chamber S3 and the top of the inside cylindrical wall 206 are formed at almost the same height.

The discharge electrode holding member 22 mounted on the base end 21*a* of the discharge electrode 21 is configured of the outer circumferential member 221 in ring shape and an inner circumferential member 222 intruded into the outer circumferential member 221 (FIGS. 8 and 10). The outer circumferential member 221 is made up of a metal-made processed component, and the inner circumferential member 222 is made up of a molded resin article. The inner circumferential member 222 has the central long hole 222*a*, and the base end 21*a* of the discharge electrode 21 is intruded into this central long hole 222*a*.

The outer circumferential surface of the outer circumferential member 221 has three circumferential flanges 221*a*, 221*b*, 221*c* which are located in a mutually vertically spaced condition, and between these flanges, circumferential grooves 221*d*, 221*e* located in a vertically spaced condition (FIGS. 8 and 10) are formed. The upper flange 221*a* located on the base end side of the discharge electrode 21 has the largest diameter, the lower flange 221*c* located on the top side of the discharge electrode 21 has the smallest diameter, and the intermediate flange 221*b* located in between the upper and lower flanges 221*a* and 221*c* has an intermediate diameter.

In correspondence with the outer circumferential member 221, two stages 201*a*, 201*b* are formed at the top of the inner surface of the outside cylindrical wall 201 of the unit body 20 (FIGS. 9 and 10). Specifically, a portion adjacent to the top of the inner surface of the outside cylindrical wall 201 has a relatively large diameter, a portion beyond the first stage 201*a* under the stage 201*a* has an intermediate diameter, and a portion beyond the second stage 201*b* under the stage 201*a* has a relatively small diameter. In the above outer circumferential member 221, the upper flange 221*a* is placed in the top section of the outer circumferential member 221, the intermediate flange 221*b* is placed in the vicinity of the first stage 201*a*, and the lower flange 221*c* is placed in the vicinity of the second stage 201*b*. Thereby, the circumferential chamber S1, which is continued in the circumferential direction of the first stage, is defined in an airtight state by the first circumferential groove 221*d* between the upper flange 221*a* and the intermediate flange 221*b*, and the second-stage circumferential chamber S2 is defined in an airtight state by the second circumferential groove 221*e* which is continued in the circumferential direction between the intermediate flange 221*b* and the lower flange 221*c*. The lower-stage flange 221*c* is located upward while spaced over the top of the inside cylindrical wall 206, whereby the circumferential chamber S3, which is expanded and circumferentially continued while continued to the foregoing first gas pool 26 and gas outflow channel 25 for shielding, is formed under the lower-stage flange 221*c* (FIG. 10).

Figure 12:
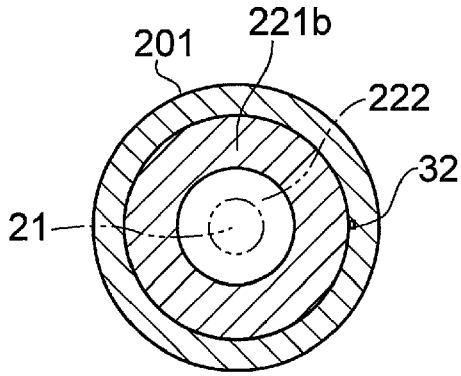
FIG. 12 is a sectional view along line XII-XII of FIG. 10.
Figure 13:
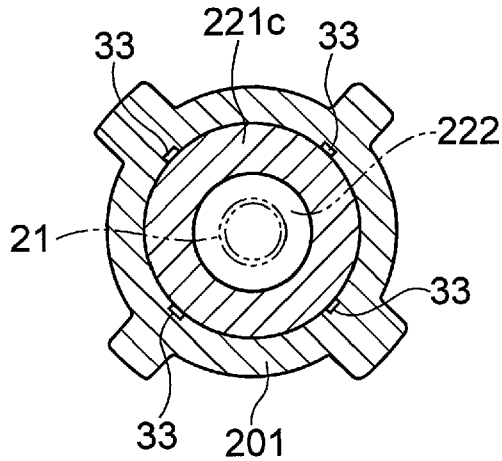
FIG. 13 is a sectional view along line XIII-XIII of FIG. 10.

On the inner wall of the outside cylindrical wall 201 of the unit body 20, in the portion having relatively the largest diameter in the top section, one first chase 31 is formed (FIGS. 8 to 11). Further, one second chase 32 is formed between the first stage 201*a* and the second stage 201*b* (FIGS. 10 and 12), and four third chases 33 extending from the second stage 201*b* to the longitudinally central portion of the outside cylindrical wall 201 are formed (FIGS. 9, 10 and 13). The first to third chases 31 to 33 extend in parallel with the shaft line of the outside cylindrical wall 201. Further, the third chase 33 will be described in detail with reference to FIGS. 9 and 10. The deep section of the third chase 33 extends downward beyond the top of the inside cylindrical wall 206 and penetrates down to the inside of the first gas pool 26.

With reference to FIG. 10, in the expanded head section 202 of the unit body 20, a second gas pool 35 is formed around the bottom of the foregoing central long hole 206*a* and a taper surface 207*a* continued thereto by the main member 204 and the auxiliary member 205. The second gas pool 35 is circumferentially continued. To this second gas pool 35, a clean gas is supplied from the foregoing internal gas channel 10 through an assist gas inflow channel 36 formed between the inner circumferential surface of the auxiliary member 205 and the bottom of the outside cylindrical wall 201 (FIG. 3). A total of four assist gas inflow channels 36 are provided with circumferential spacing of 90 degrees (see FIGS. 8 and 9). In the expanded head section 202, the assist gas inflow hole 37 configured of a thorough hole with a small diameter is formed on the bottom surface of the main member 204, and through this assist gas inflow hole 37, the clean gas inside the second gas pool 35 is allowed to flow to the outside. As is the most apparent from FIG. 4, the total of four assist gas inflow holes 37 are formed with spacing of 90 degrees on a circumference concentric with the central opening section 207 around the central opening section 207 of the expanded head section 202.

A flow rate of the clean gas inside each of the assist gas inflow holes 37 is previously set to about 200 m/sec. Since the clean gas discharged from the assist gas inflow hole 37 under such control is released from the restraint of the diameter of the assist gas inflow hole 37, though it flows at a far low flow rate than about 200 m/sec, it outflows downward in a conical shape at a far higher flow rate than the flow rate of a later-described ionized clean gas discharged from the gas outflow channel 25 for shielding.

The foregoing first chase 31 and second chase 32 on the inner wall of the outside cylindrical wall 201 are in the positional relation of being circumferentially offset by 180 degrees. That is, the first chase 31 and the second chase 32 are set so as to be in the relation of being disposed while diametrically opposed to each other. Further, the four three chases 33 are mounted with circumferential spacing of 90 degrees, and each third chase 33 is formed in the relation of being circumferentially offset by 45 degrees from the second chase 32.

It is to be noted that, although the additional discharge electrode unit 3 and the main discharge electrode unit 2 substantially have the same configuration as described above, the additional discharge electrode unit 3 is different from the main discharge electrode unit 2 in not having the assist gas function. Therefore, in the additional discharge electrode unit 3, the second gas pool 35 provided in the main discharge electrode unit 2, and the assist gas inflow channel 36 and the assist gas inflow hole 37, which are relevant to the second gas pool 35, are not present.

Figure 14:
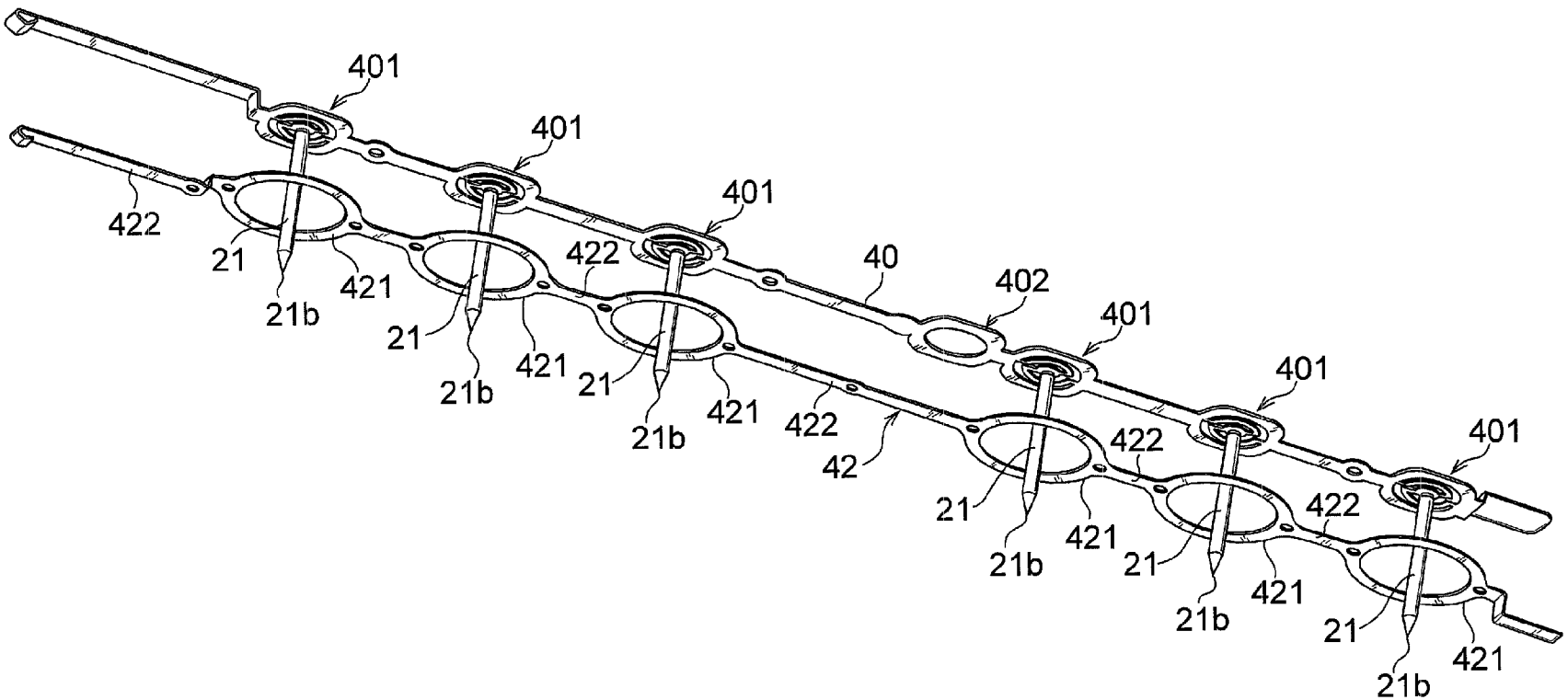
FIG. 14 is a perspective view for explaining, by extracting, a distribution plate to supply a high voltage to a discharge electrode and a ground electrode plate around each discharge electrode.

FIG. 14 is a view for explaining application of a high voltage to each discharge electrode 21 of the main discharge electrode unit 2 and the additional discharge electrode unit 3 and a configuration concerning a ground electrode mounted around each discharge electrode 21. With reference to FIG. 14, a high voltage is supplied to each discharge electrode 21 by the distribution plate 40. The distribution plate 40 has a web shape continuously extending over the full length of the half base 5A, and a portion 401 engaged with the base end 21*a* of each discharge electrode 21 has been press-molded in S-shape for providing spring properties to the central portion of this engagement portion 401. The circumferential groove 211 of each discharge electrode 21 is engaged with the circular hole in the central portion of this S shape (FIG. 3). A circular hole 402 is formed in the longitudinal central portion of the distribution plate 40.

In a case where the total length of one half base 5A is 23 cm and a large number of this type of half bases 5A are connected to make the length of the static eliminator larger than, for example, 2.3 m, an amount of a gas supplied to the longitudinal central portion of the static eliminator might become smaller than other portions, with only the foregoing clean gas supplied from both ends of the longitudinal direction of the static eliminator. Therefore, in the static eliminator 1 having such a length, in addition to the supply of the clean gas from both ends thereof, the clean gas may be supplied from one end of the longitudinal direction to the outer case 4 through a pipe, through the circular hole 402 provided in the half base 5A disposed in the approximately central portion of the foregoing static eliminator and an opening formed in part of the top surface of the half base provided in the above-mentioned position, one end of the pipe for supply of the clean gas may be faced to internal gas channel 10.

Needless to say, as for the static eliminator 1 long enough to ensure a required gas amount by the supply of the gas from both ends thereof, it is not necessary to form an opening on the top surface of the half base 5A corresponding to the circular hole 402 and the position thereof. Further, although not shown, as for the static eliminator 1 in which the clean gas is supplied to the internal gas channel 10 by use of the circular hole 402, the high voltage unit 6 and the control substrate 7 are disposed in a space inside the outer case from the end of the longitudinal direction of the static eliminator, opposite to the one end provided with the pipe for supplying the clean gas is provided, to the circular hole 402 faced by the pipe, so as to avoid interference with the pipe.

Figure 15:
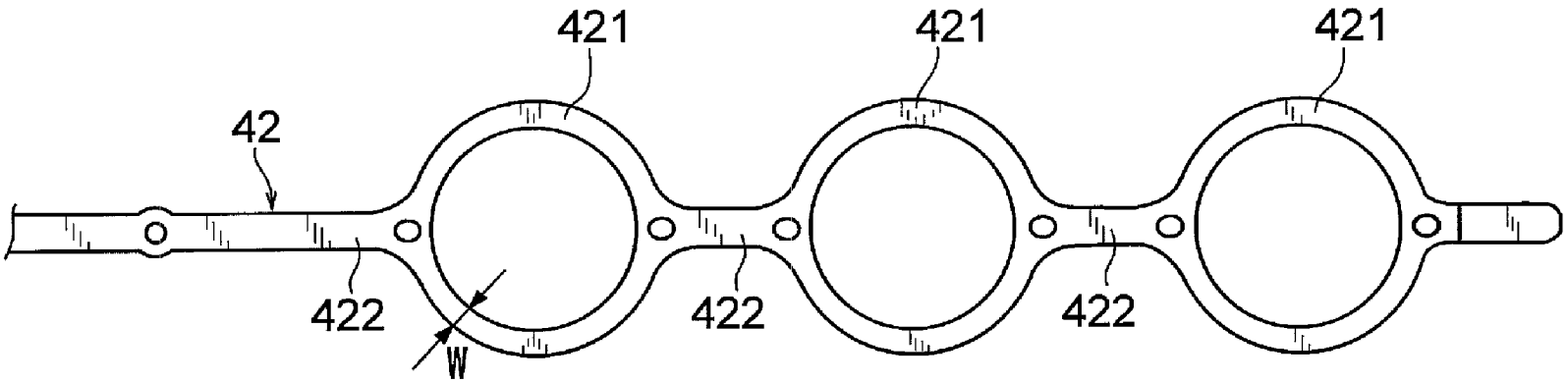
FIG. 15 is a partial plan view of the ground electrode plate.

Continuously with reference to FIG. 14, an opposing electrode, namely a ground electrode plate member 42, is mounted around each discharge electrode 21 (FIG. 3). In this embodiment, the ground electrode plate member 42 is configured of a plate member, and includes a circular ring section 421 concentric with each discharge electrode 21, and a linear connecting section 422 that connects each circular ring section 421 (FIGS. 3 and 15). This ground electrode plate member 42 is buried inside the bottom side of the half base 5A shown in FIG. 6. This circular ring section 421 is mounted in a position as high as where the foregoing gas outflow channel 25 for shielding and the first gas pool 26 located on the outer circumferential side of the gas outflow channel 25 for shielding are present. More specifically, each circular ring section 421 of the ground electrode plate member 42 is configured so as to surround the discharge electrode 21 on the base 5 constituting the lower portion of the static eliminator 1, and in the inside of the circular ring section 421, the main discharge electrode unit 2 or the additional discharge electrode unit 3 is disposed. In the present embodiment, the circular ring section 421 is disposed in the state of being buried inside the base 5 on the base 5 side through the internal gas channel 10 formed inside the base 5 from the outside cylindrical wall 201 of the main discharge electrode unit 2.

The distribution plate 40 is fixedly mounted on a ceiling wall 501 of the half base 5A, and each circular ring section 421 of the ground electrode plate member 42 is buried on the bottom surface side of the half base 5A where the discharge electrode units 2, 3 are held and in the vicinity of a side-surface-side side wall 502 (FIG. 3). At least, a portion 502*a* in which the ground electrode plate member 42 is buried is made of an insulating material, e.g. a synthetic resin material excellent in insulating properties. The circular ring section 421 included in the ground electrode plate member 42 in plate shape has a width W (FIG. 15) smaller than the thickness of the side wall 502 of the half base 5A, and is mounted so as to not to be exposed from the half base 5A to the outside. As thus described, since the circular ring section 421 of the ground electrode plate member 42 is mounted around the discharge electrode 21 with the ground electrode plate member 42 in the buried state, an electric field formed between the discharge electrode 21 and the ground electrode (ground electrode plate member 42) can be relatively weakened without generating surface discharge from the discharge electrode 21 to the ground electrode plate member 42, namely between the circular ring section 421 and the discharge electrode 21. It is thereby possible to relatively strengthen the electric field between the discharge electrode 21 and a workpiece (not shown).

More specifically, the smaller the diameter of the circular ring 421, the more possible it is to weaken the electric field formed between the discharge electrode 21 and the ground electrode plate member 42 to the utmost, whereas a withstand voltage between the circular ring 421 and the discharge electrode 21 might not be maintained when the diameter of the circular ring 421 is made excessively small. For this reason, it is preferable that the diameter of the circular ring 421 be large enough to maintain the withstand voltage between the circular ring 421 and the discharge electrode 21, while being small enough to weaken the electric field formed between the discharge electrode 21 and the ground electrode plate member 42 to the utmost. The diameter of the circular ring 421 in the present embodiment, in the case of the discharge electrode 21 being set as its diametrical center, is larger than the first gas pool 26 and smaller than the outside cylindrical wall 201.

Further, each circular ring 421 formed around each discharge electrode 21 is connected with each other by the connecting section 422 which has a smaller width than the diameter of the circular ring 421 and extends linearly. The connecting section 422 is disposed on almost a straight line connecting the discharge electrodes 21, 21, while in the state of being incorporated in the static eliminator 1. Further, this straight-line section 422 preferably has a small width in order to weaken the electric field formed between the discharge electrode 21 and the ground electrode plate member 42 to the utmost, so long as satisfying feeding performance, rigidity in assembly, and the like. That is, the connecting section 422 of the ground electrode plate member 42 is buried on almost a straight line connecting the discharge electrodes 21, 21 and in a portion between the adjacent discharge electrodes 21, 21 on the bottom surface side of the half base 5A where the discharge electrode units 2, 3 are held.

It is to be noted that, although the ground electrode plate member 42 is configured of a plate made of a metal press molded article in the embodiment, it is not necessarily a plate, and it goes without saying that a similar configuration may be formed using, for example, a wire-like linear member.

Figure 19:
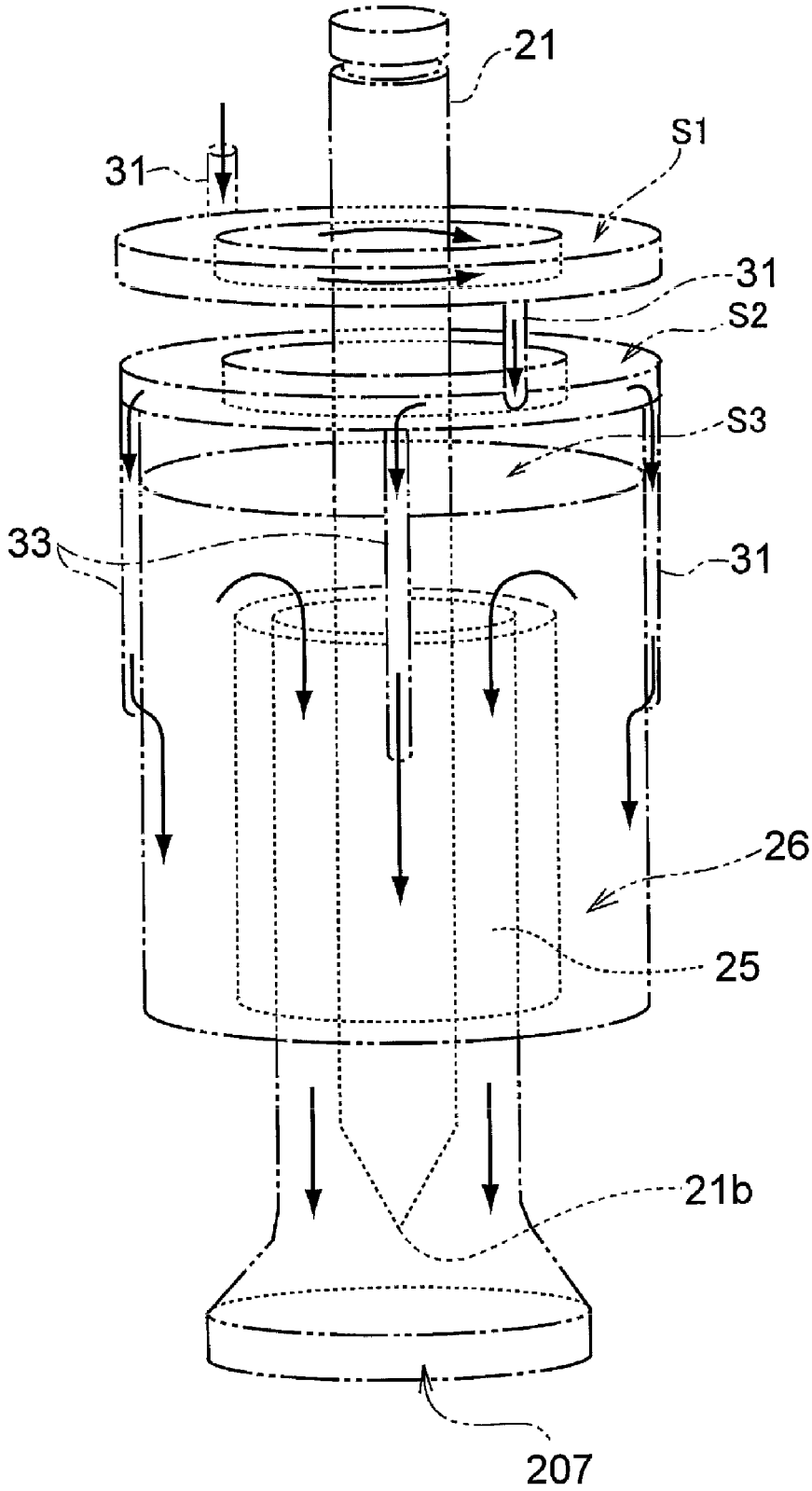
FIG. 19 is a view for explaining the relation of chambers, orifices, gas pools and a gas channel for shielding, relevant to the flow of the clean gas inside the discharge electrode unit.

With reference to FIGS. 16 to 19, description will be given of the flow of a gas for shielding, which surrounds the leading end 21*b* of the discharge electrode 21 to suppress contamination of the discharge electrode 21. Here, FIG. 19 is a conceptual view of a configuration relevant to the gas flow.

An air purified by a filter or the like, or a clean gas such as an inert gas like a nitrogen gas, is supplied to the internal gas channel 10, and the clean gas flowing through this internal gas channel 10 flows into the first-stage circumferential chamber S1 through a first orifice that is defined by the foregoing one first chase 31, with the influence of pulsation of the internal gas channel 10 being in a suppressed state. The clean gas inside the first-stage circumferential chamber S1 flows into the second-stage circumferential chamber S2 through a second orifice that is defined by one second chase 32 provided in a position diametrically opposed to the first chase 31. The clean gas inside the second-stage circumferential chamber S2 then passes through a third orifice that is defined by four third chases 33 circumferentially offset from the second chase 32 by 45 degrees, and flows downward.

The clean gas flowing through the internal gas channel 10 of the half base 5A flows into the first-stage and second-stage circumferential chambers S1, S2 through the first and second orifices made up of the first and second chases 31, 32, and the clean gas inside the second-stage chamber S2 then flows into the first gas pool 26 through the four third chases 33. That is, the clean gas inside the second-stage circumferential chamber S2 is guided by the four third chases 33 to flow into the first gas pool 26, and since the deep portion of this first gas pool 26 extends down to the expanded head section 202, it is possible to convert the clean gas flown into the first gas pool 26 into static pressure.

In particular, since the clean gas is supplied to the first gas pool 26 through the circumferentially spaced multi-stage orifices, which are the foregoing first and second chases 31, 32 one each, it is possible to improve the static pressure of the clean gas inside the first gas pool 26 to a high level while shutting off the influence of pulsation of the internal gas channel 10. The clean gas inside the first gas pool 26 then passes over the top of the inside cylindrical wall 206 through the circumferential chamber S3 circumferentially expanded from this first gas pool 26, and flows into the gas outflow channel 25 for shielding inside the inside cylindrical wall 206.

Since, as described above, the gas outflow channel 25 for shielding extends in a thin long cylindrical shape along the outer circumference of the discharge electrode 21 from the longitudinal central portion to the top 21*b* of the discharge electrode 21, the clean gas that passes inside this gas outflow channel 25 for shielding becomes a laminar flow and outflows downward through the central opening section 207. Therefore, the clean gas flowing along the longitudinal direction of the discharge electrode 21 inside the gas outflow channel 25 for shielding located in contact with the outer circumferential surface of the discharge electrode 21 becomes a laminar flow in the process of passing through the gas outflow channel 25 for shielding and outflows toward the workpiece while in the state of surrounding the leading end 21*b* of the discharge electrode 21, whereby it is possible to improve a sheath effect of the discharge electrode 21 with respect to the leading end 21*b*, so as to improve the effect of preventing contamination of the discharge electrode 21.

In the present embodiment, the flow rate of the clean gas inside the gas outflow channel 25 for shielding in contact with the outer circumferential surface of the discharge electrode 21 is set to about 1 m/sec. Since the ionized clean gas controlled in this manner and discharged from the central opening section 207 is released from the restraint of the diameter of the gas outflow channel 25 for shielding, it outflows downward at a far lower flow rate than about 1 m/sec in the shape of a cylinder having a diameter almost as large as a final open end of the central opening section 207.

Further, since the inner or outer double walls in the outward diametrical direction of the discharge electrode 21, namely the inside cylindrical wall 206 and the outside cylindrical wall 201, form the first gas pool 26 extending to the leading end of the discharge electrode 21, it is possible to set the diameter of the outside cylindrical wall 201 of the main discharge electrode unit 2 to be small, while maintaining the static pressure effect of the first gas pool 26.

As the most well understood from FIG. 19, the following configuration has been adopted to the static eliminator 1 of the embodiment; the first-stage circumferential chamber S1, the second-stage circumferential chamber S2 and the first gas pool 26 are arrayed in series along the longitudinal direction of the discharge electrode 21, and the first gas pool 26 and the gas outflow channel 25 for shielding which is located on the inner circumferential side of this first gas pool 26 are disposed in a diametrically overlapping mode; and the clean gas is supplied to the first gas pool 26 through the spaces S1, S2 disposed at multi-stages by means of the circumferentially spaced multi-stage orifices (the first and second chases 31, 32). Accordingly, it is naturally possible not only to shut off the first gas pool 26 from the pulsation of the internal gas channel 10, but also to improve the static pressure of the first gas pool 26 as thus described, and since the multi-stage orifices (first and second chases 31, 32) are formed in the inner surface of the outside cylindrical wall 201 and the vertically multi-stage flanges 221*a* to 221*c* are also formed on the outer circumferential surface of the discharge electrode holding member 22 cantilevering the discharge electrode 21 so that the first and second circumferential grooves 221*d*, 221*e* between these flanges form the multi-stage spaces S1, S2, it is possible to form the state where the multi-stage spaces S1, S2 and the first gas pool 26 are arrayed in the longitudinal direction of the discharge electrode 21, so as to shut off the pulsation of the foregoing gas for shielding and ensure high-level static pressure, and simultaneously set the diameter of the outside cylindrical wall 201 to be small.

Description will be given below of the ground electrode plate member 42 mounted so as not to be exposed to the outside around the discharge electrode 21. As described above with reference to FIG. 3, the circular ring section 421 of the ground electrode plate member 42 is buried in the vicinity of the side wall 502, made of an insulating synthetic resin material, on the bottom surface side of the half base 5A, and this circular ring section 421 of the ground electrode plate member 42 is mounted circumferentially with the discharge electrode 21 (FIG. 14). By adoption of the configuration as thus described in which the ground electrode plate member 42 (circular ring section 421) is buried and not exposed to the outside, as compared with the conventional configuration in which the ground electrode plate is exposed to the outside, it is possible to relatively weaken an electric field that generates between the discharge electrode 21 and the ground electrode plate member 42, thereby to relatively strengthen an electric field between the discharge electrode 21 and a workpiece (not shown), and thus make more improvement in static elimination efficiency than in the case of the conventional configuration.

Figure 17:
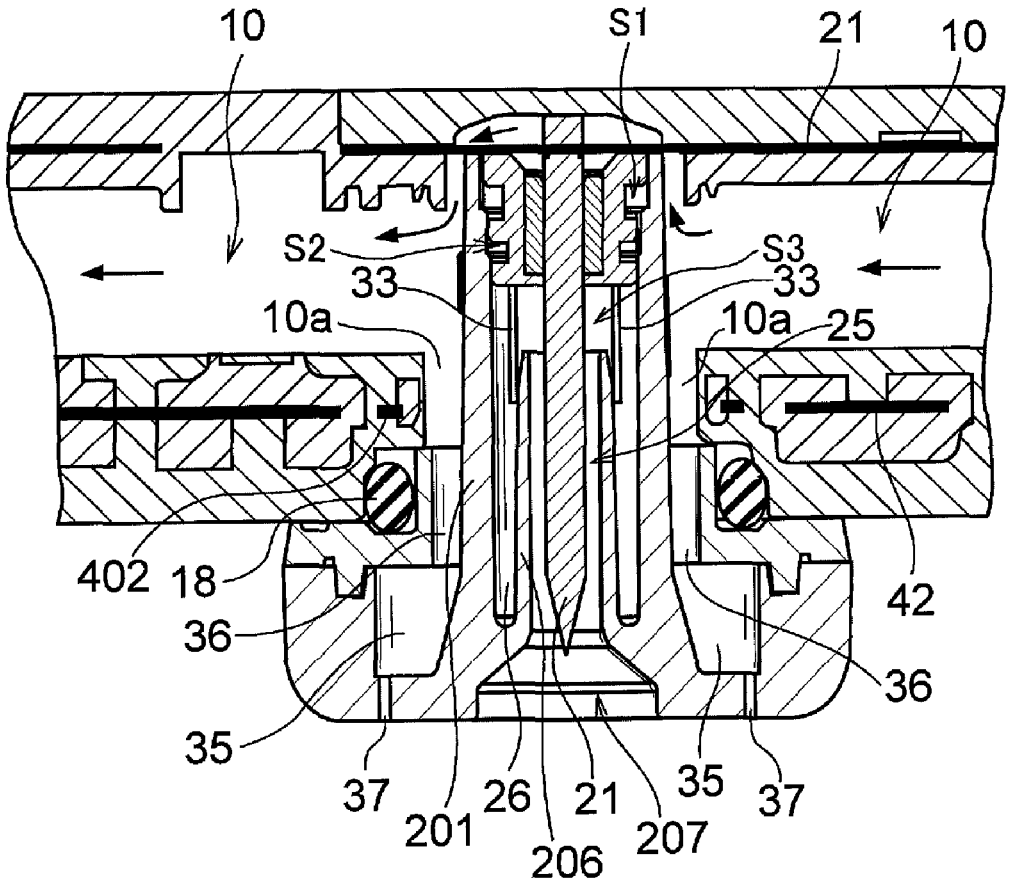
FIG. 17 is an expanded sectional view in which a region X17 portion of the half base has been extracted.
Figure 18:
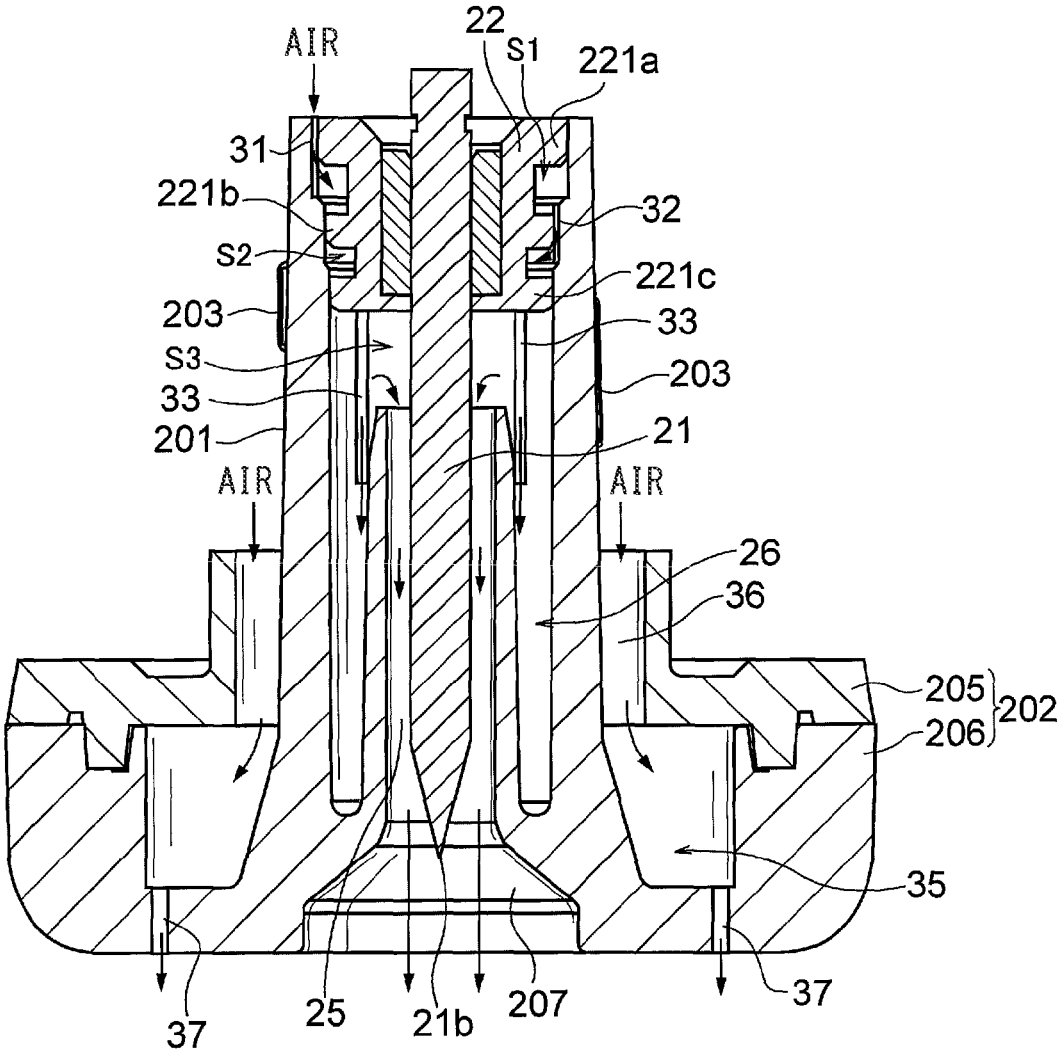
FIG. 18 is a sectional view corresponding to FIG. 10, for explaining the flow of a clean gas inside the discharge electrode unit.

Further, as seen from FIGS. 3 and 17, on the flat surface made up by the ground electrode plate member 42, a channel 10*a* for supplying a clean gas from the internal gas channel 10 to the second gas pool 35, the first gas pool 26, and a gas layer inside the gas outflow channel 25 for shielding intervene between the discharge electrode 21 and the circular ring section 421 of the ground electrode plate member 42. Since the gas has a lower dielectric constant than that of the synthetic resin material and thus has a higher withstand voltage, insulating properties between the ground electrode plate member 42 and the discharge electrode 21 are easily ensured. In other words, rather than making insulation between the ground electrode plate member 42 and the discharge electrode 21 only by means of the insulating synthetic resin, making the air layer with a relatively high withstand voltage intervene therebetween can design the spaced distance between the discharge electrode 21 and the ground electrode plate member 42 (circular ring section 421) to be small on the flat surface made up by the ground electrode plate member 42. More specifically, the spaced distance between the discharge electrode 21 and the inner circumferential edge of the circular ring section 421 is set to a value obtained out of consideration of the insulation withstand pressure of the channel 10*a* (FIG. 17) for supplying a clean gas to the second gas pool 35, the first gas pool 26 and the gas layer of the gas outflow channel 25 for shielding, and it is possible to set the inner diameter of the circular ring section 421 to be as small as the spaced distance with which the withstand voltage, including that of the gas layer, can be ensured.

In the foregoing embodiment, the flow rate of the clean gas inside the gas outflow channel 25 for shielding in contact with the outer circumferential surface of the discharge electrode 21 is set to about 1 m/sec and the flow rate of the clean gas inside each assist gas inflow hole 37 is set to about 200 m/sec. However, these specific numeric values of the flow rates inside the gas outflow channel 25 for shielding and the assist gas inflow hole 37 are mere examples. Naturally, for example, the flow rate of the clean gas inside the gas outflow channel 25 for shielding can be set to be higher than 1 m/sec for the purpose of increasing the speed of static elimination of the workpiece (purpose of increasing the speed of arrival of ions at the workpiece), and for example, a flow rate value of the clean gas inside the gas outflow channel 25 for shielding may be approximately the same as a flow rate value of the clean gas inside the assist gas inflow hole 37.

Figure 20:
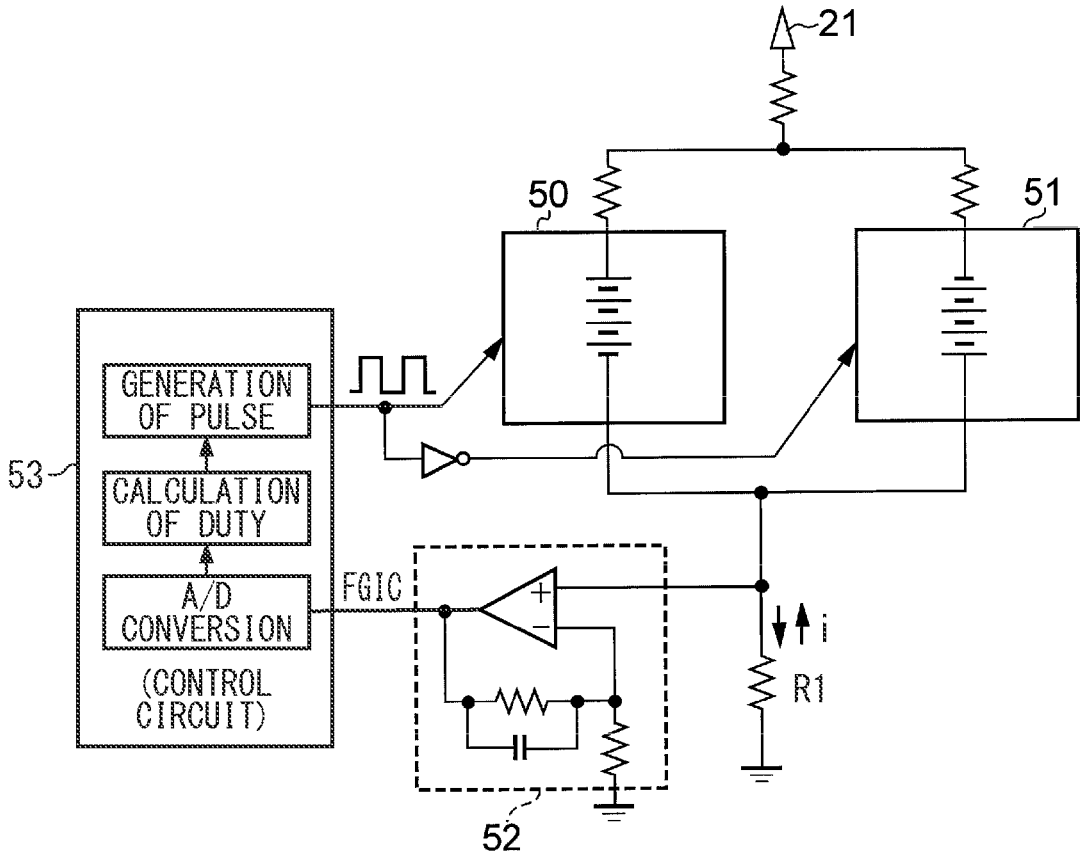
FIG. 20 is a circuit block diagram of a static eliminator in a pulse AC system, relevant to a change in ion balance target value.

Next, detection of a contamination condition of the discharge electrode 21 and display of the detected condition will be described below. FIG. 20 is a circuit block diagram in the case of adopting a pulse AC system as a system for applying a high voltage to the discharge electrode 21. With reference to FIG. 20, a positive or negative high voltage is alternately applied from a positive high voltage power circuit 50 or a negative high voltage power circuit 51 to the discharge electrode 21. The positive and negative high voltage power circuits 50, 51 are grounded through a resistor R1. A current flowing through this resistor R1, namely an ion current i, is averaged in an amplification/low-pass filter circuit 52, and inputted into a control circuit 53 as a frame ground current FGIC. In the control circuit 53, positive and negative high voltages Duty that are applied to the discharge electrode 21 are feedback-controlled such that a value of the frame ground current FGIC is a prescribed target value.

Figure 21:
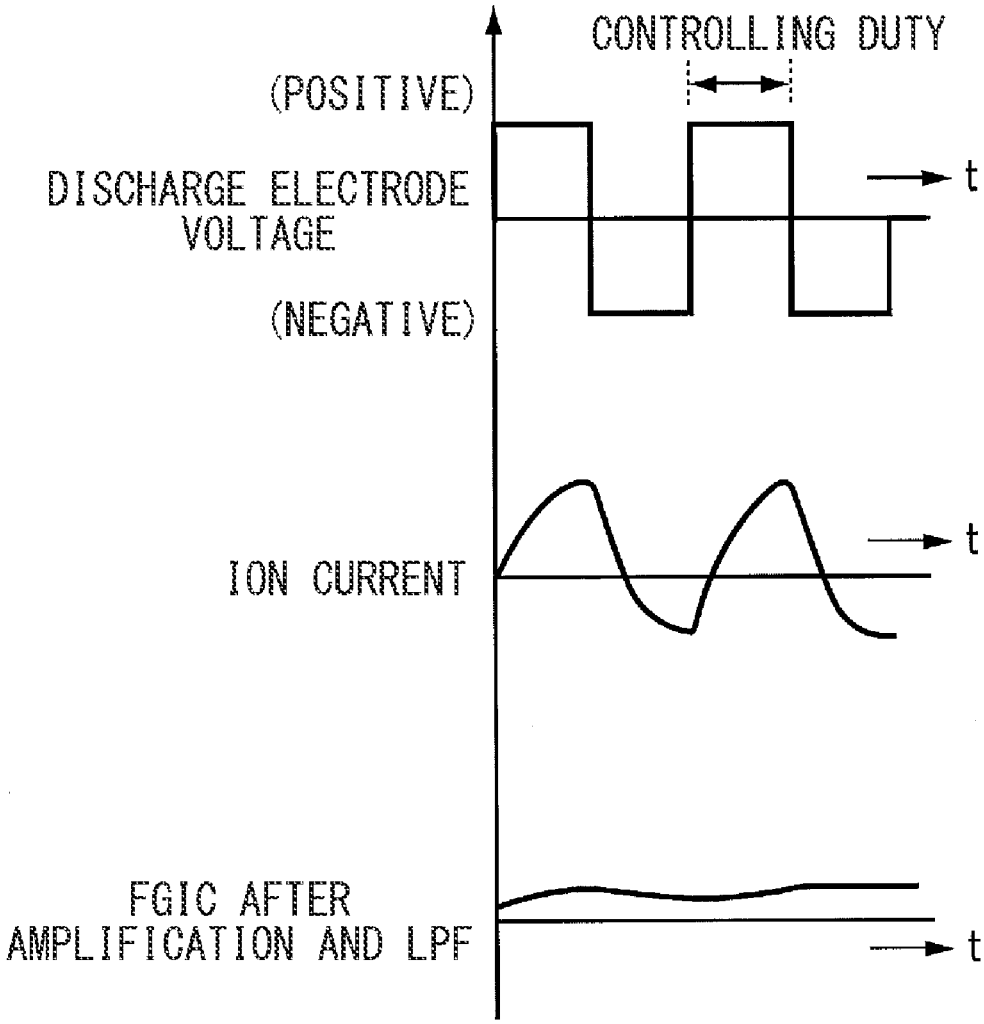
FIG. 21 is a waveform diagram of an ion current flowing between the discharge electrode and a frame ground (FG) when a high voltage is applied to the discharge electrode in the pulse AC system, and a frame ground current FGIC after averaging of the ion current.

In a waveform diagram of FIG. 21, a waveform at the top relates to the voltage to be applied to the discharge electrode 21, a waveform in the middle relates to the ion current i flowing through the resistor R1, and a waveform at the bottom relates to the frame ground current FGIC that is inputted from the amplification/low-pass filter circuit 52 into the control circuit 53. The positive and negative high voltages Duty that are applied to the discharge electrode 21 are feedback-controlled such that a value of the frame ground current FGIC is a target value.

Figure 22:
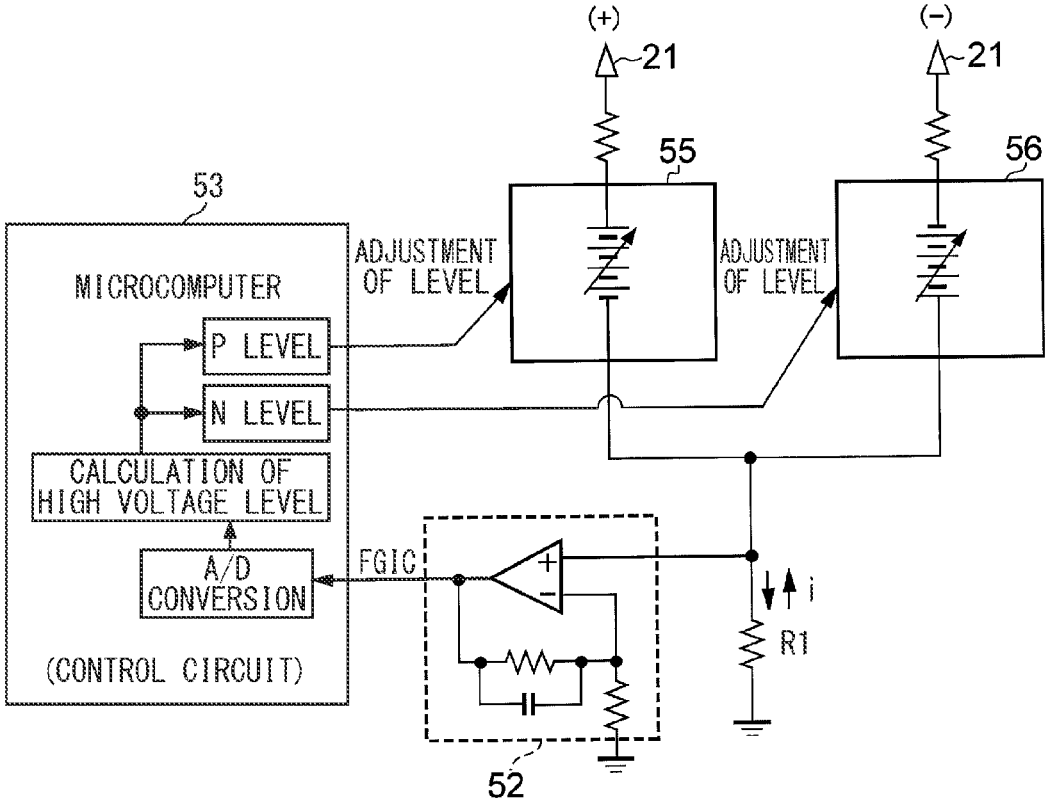
FIG. 22 is a circuit block diagram of a static eliminator in a DC system, relevant to a change in ion balance target value.

FIG. 22 is a circuit block diagram in the case of adopting a variable DC system. The circuit in the variable DC system has variable high voltage power circuits 55, 56 which apply positive and negative voltages respectively to a pair of the discharge electrodes 21, 21. Signals for adjusting voltage levels are outputted from the control circuit 53 to the positive and negative variable high voltage power circuits 55, 56, and values of high voltages generated by the positive and negative variable high voltage power circuits 55, 56 are feedback-controlled.

Figure 23:
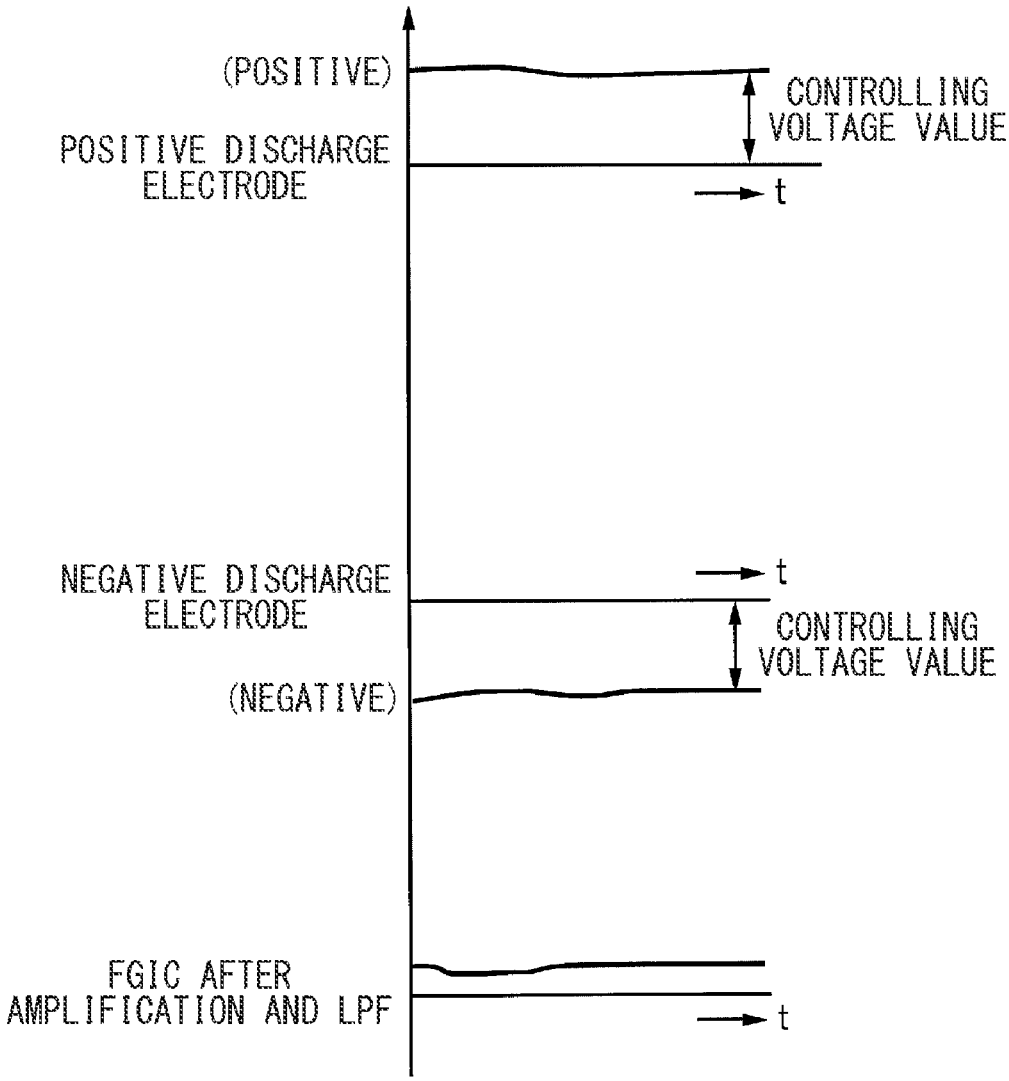
FIG. 23 is a waveform diagram of a frame ground current FGIC after averaging of the ion current flowing between the positive and negative discharge electrodes and the frame ground (FG) when a high voltage is applied to the discharge electrodes in the DC system.

In a waveform diagram of FIG. 23, a waveform at the top indicates a high voltage that is applied to the positive discharge electrode 21, a waveform in the middle indicates a high voltage that is applied to the negative discharge electrode 21, and a waveform at the bottom indicates the frame ground current FGIC that is inputted from the amplification/low-pass filter circuit 52 into the control circuit 53. Voltage values of the positive and negative high voltages that are applied to the discharge electrode 21 are feedback-controlled such that a value of the frame ground current FGIC is a target value.

As for the ion generation control, the operation amount in the case of the static eliminator 1 in the AC system is Duty, and the operation amount in the case of the static eliminator 1 in the DC system is the voltage value that is applied to the discharge electrode 21. What is common therebetween is that the value of the frame ground current FGIC is feedback-controlled so as to become a prescribed target value. Therefore, although the case of the AC system will be described below, it should be understood as also applicable to the DC system.

First, a mode for setting a target value is arbitrarily selectable from the following.

(1) A basic ion balance target value is set, for example to "zero", and is changed to a target value offset to such a degree as not to significantly affect the ion balance of the workpiece with prescribed time intervals, namely intermittently.

(2) A target value is constantly set which is offset to such a degree as not to affect the ion balance of the workpiece.

"Such a degree as not to affect the ion balance of the workpiece" concerning a deliberate variation in ion balance target value will be described. An allowable charging voltage of the workpiece varies depending on a user of the static eliminator 1 and/or the kind of workpiece as a target for static elimination. There are, for example, a case where the charging voltage of the workpiece after static elimination is in an allowable range when it is within ±200 V, and a case where the charging voltage is required to be within ±30 V. Hence, the meaning of "such a degree as not to affect the ion balance of the workpiece" is basically a width of variation in target value held within the charging voltage of the workpiece after static elimination, the voltage being allowable in accordance with the user and/or the workpiece as the target for static elimination. Accordingly, while the user may be made to decide the width of change in ion balance target value, when a manufacturer of the static eliminator 1 is to define the width of variation made to "such a degree as not significantly affect the ion balance of the workpiece", the manufacturer may define the width of variation in ion balance target value such that the width of variation in charging voltage of the workpiece after static elimination is held within the range of ±15 V, preferably ±10 V, and further preferably ±5 V. This is sufficiently applicable even to a case where a strict condition for static elimination is required by the user or the work as the target. The width of variation in target value may be defined so as to be held within a width of variation of not larger than 1% in terms of duty of the pulse AC.

Figure 24:
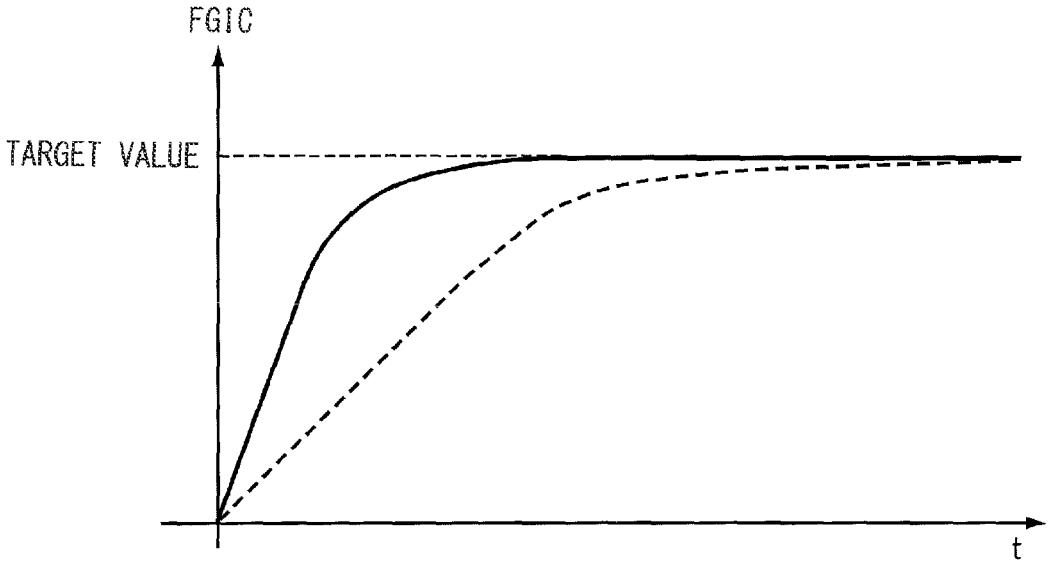
FIG. 24 is a diagram for explaining that follow-up performance of control varies depending on a contamination condition of the discharge electrode with respect to the change in ion balance target value, where a solid line indicates the case of a new discharge electrode, and a broken line indicates the case of a discharge electrode with contamination having progressed.
Figure 25:
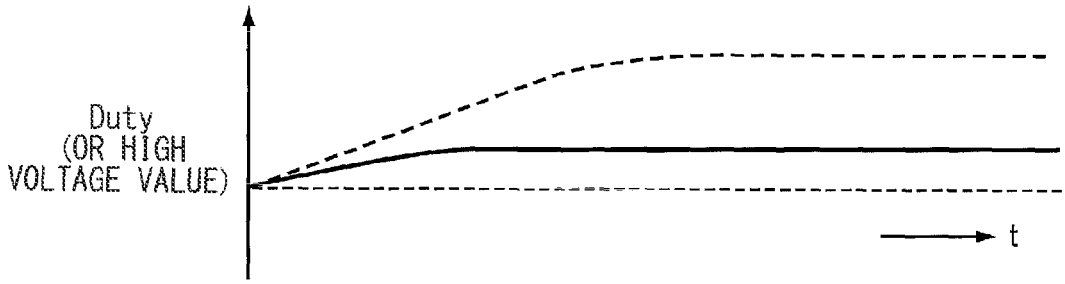
FIG. 25 is a diagram for explaining that an operation amount varies depending on the contamination condition of the discharge electrode with respect to the change in ion balance target value.

FIG. 24 is a diagram for explaining the relation between the follow-up performance of the control with respect to the change in ion balance target value and the contamination condition of the discharge electrode 21. The case of the discharge electrode 21 with no contamination, for example a new one, is indicated by a solid line, and the case of the discharge electrode 21 with contamination due to its use is indicated by a broken line. As seen from FIG. 24, the follow-up performance with respect to the target value is more excellent in the case of the discharge electrode 21 "without contamination". This means that the discharge electrode 21 "without contamination" has higher ion generation efficiency than the discharge electrode 21 "with contamination", and thus rapidly follows up the change in target value. In other words, as shown in FIG. 25, the operation amount makes a smaller variation in the case of the discharge electrode 21 "without contamination" (solid line), and the operation amount makes a larger variation in the case of the discharge electrode 21 "with contamination" (broken line). It is to be noted that the time required for a value of an actual frame ground current FGIC to follow up the change in target value is from 10 to 100 seconds. For example in the pulse AC system, it can be said that this value of from 10 to 100 seconds is extremely larger than a pulse period of a voltage to be applied to the discharge electrode 21.

What is to be noted here is that the follow-up performance of the control with respect to the change in target value varies depending on the contamination condition of the discharge electrode 21. That is, the worse the contamination condition of the discharge electrode 21 becomes, i.e. the more contamination the discharge electrode 21 has, the more the follow-up performance of the control deteriorates. Through the use of this characteristic, it is possible to deliberately change the target value to such a degree as not to affect the ion balance of the workpiece, thereby to see the contamination condition of the discharge electrode 21 in accordance with the quality of the follow-up performance.

This is not limited to the case of detecting the frame ground current FGIC and performing feedback-control, but the foregoing relation between the contamination condition of the discharge electrode 21 and the follow-up performance of the control is established even in the case of detecting an ion current flowing between the discharge electrode 21 and the ground electrode (opposing electrode) and performing feedback-control. Therefore, even in the case of performing ion generation control based on a value of the ion current between the discharge electrode 21 and the opposing electrode, it is possible to deliberately change the target value, so as to see the contamination condition of the discharge electrode 21 in accordance with the quality of the follow-up performance with respect to the change.

Further, naturally, since the foregoing relation between the contamination condition of the discharge electrode 21 and the follow-up performance of the control is established equally even when the static eliminator 1 is in either the DC system or the AC system, it is possible in the static eliminator in either DC type or the AC type to deliberately change the target value, so as to determine the contamination condition of the discharge electrode 21 in accordance with the quality of the follow-up performance with respect to the change.

As the foregoing embodiments, in the case of burying the ground electrode plate member 42 in the synthetic resin material around the discharge electrode 21 to weaken an electric field that generates between the discharge electrode 21 and the ground electrode plate member 42, it is reasonable to detect the frame ground current FGIC flowing through the frame ground and perform ion generation control in accordance with the detected current. On the other hand, in the case of mounting the ground electrode (opposing electrode) exposed to the outside around the discharge electrode 21 to perform ion generation control based on a value of the ion current between the discharge electrode 21 and this opposing electrode, when, for example, a workpiece with a large capacity is present in the vicinity of the static eliminator, a current flowing between the discharge electrode 21 and the opposing electrode decreases owing to this workpiece, and this might cause incorrect detection that the amount of ion generation has been decreased, despite a sufficient amount of ion being actually generated by the discharge electrode 21, resulting in determination that the contamination condition of the discharge electrode 21 has progressed. This problem can be dissolved by detecting the frame ground current FGIC flowing through the frame ground, thereby to perform the feedback-control of the ion generation.

Figure 26:
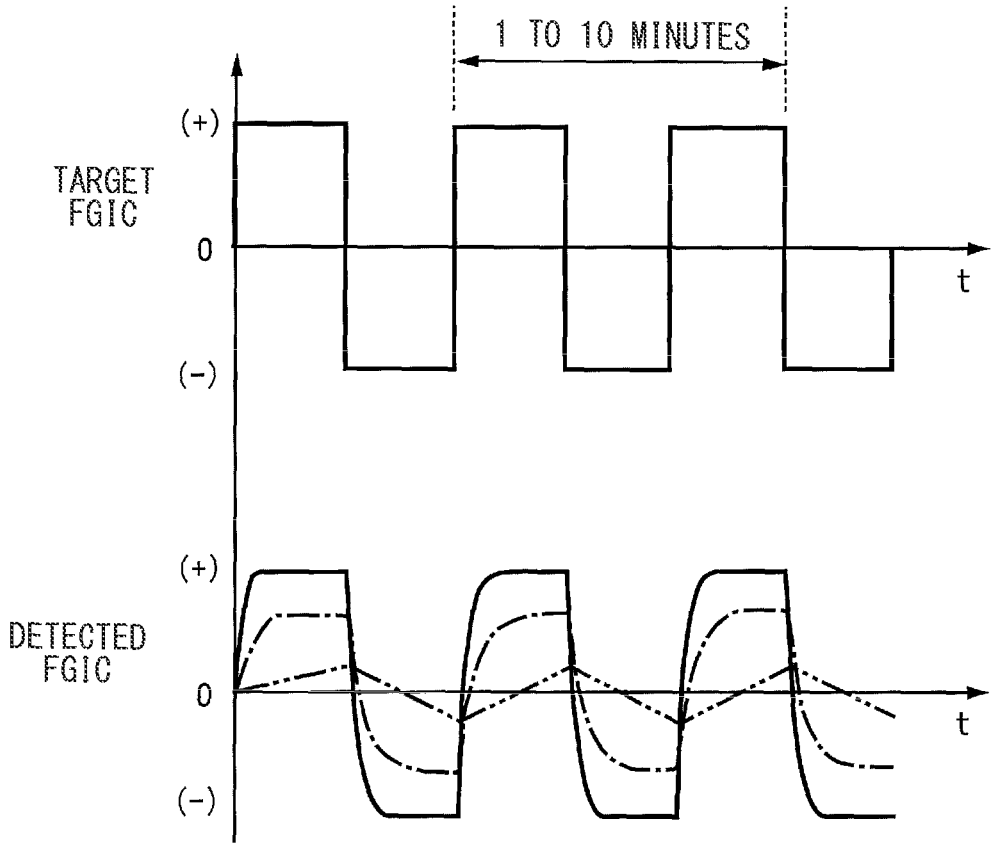
FIG. 26 is a waveform diagram showing a change in frame ground current FGIC in the case of changing the ion balance target value in rectangular pulse form, where a solid line indicates the case of a new discharge electrode, a broken line indicates the case of a discharge electrode with an moderate contamination, and a chain double-dashed line indicates the case of a discharge electrode with serious contamination.

FIG. 26 shows a specific example concerning the change in target value. With reference to FIG. 26, the target value as a target FGIC is changed alternately to the plus side and the minus side with, for example, zero taken as a reference to such a degree as not to affect the ion balance of the workpiece. As for the follow-up performance with respect to this change in target value, the time required of the frame ground current FGIC for following-up, as well as the amplitude of the frame ground current FGIC, varies depending on the contamination condition of the discharge electrode 21. A solid line indicates the case of a new discharge electrode 21, a dashed line indicates the case of a discharge electrode 21 with moderate contamination, and a chain double-dashed line indicates the case of a discharge electrode 21 with serious contamination.

Figure 27:
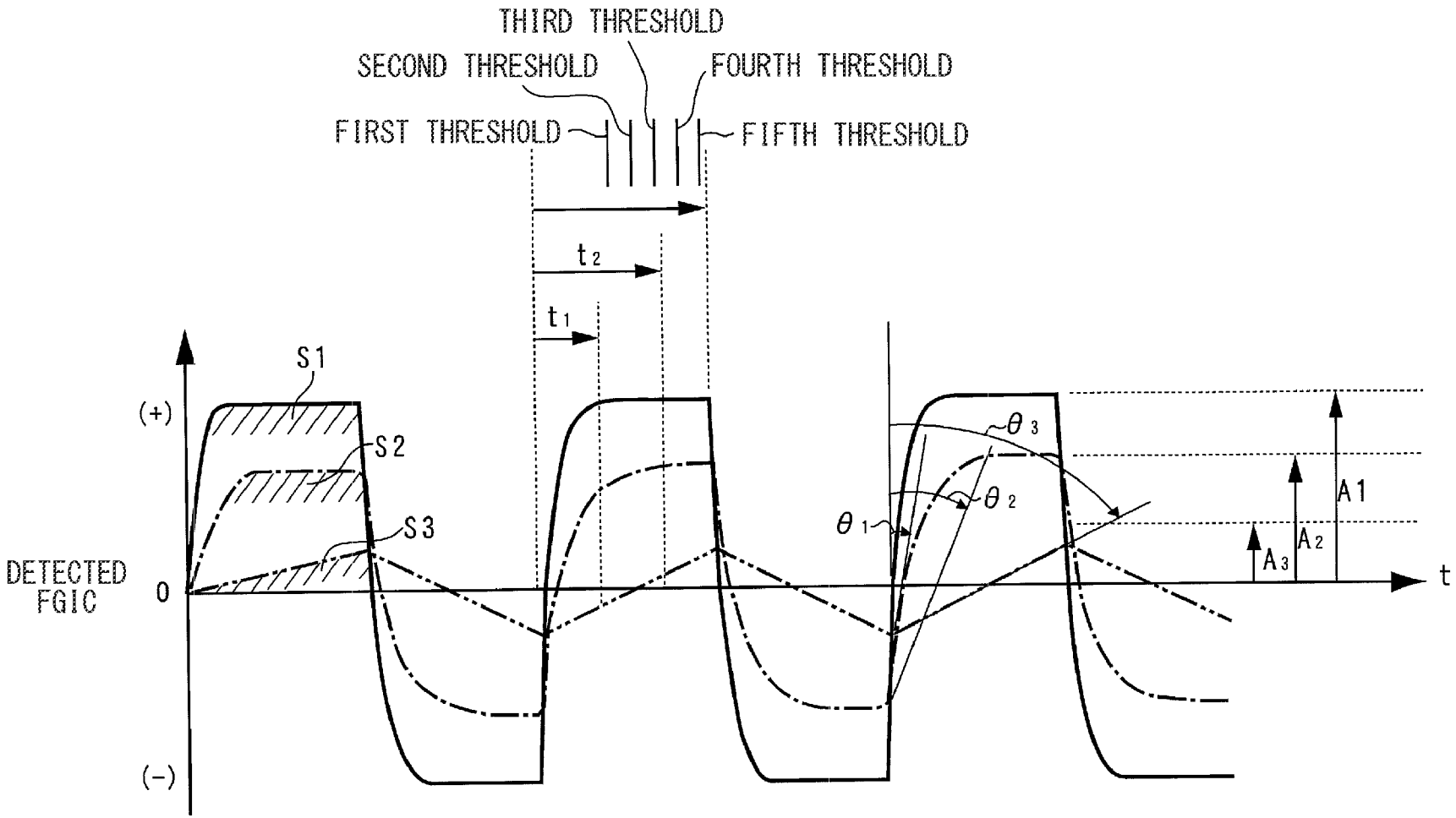
FIG. 27 is a diagram where the change in frame ground current FGIC shown in FIG. 26 has been expanded.

FIG. 27 is an expanded diagram of a waveform of the frame ground current FGIC shown in FIG. 26. In FIG. 27, as with FIG. 26, a solid line indicates the case of the new discharge electrode 21, a dashed line indicates the case of the discharge electrode 21 with moderate contamination, and a chain double-dashed line indicates the case of the discharge electrode 21 with serious contamination. As for the follow-up time with respect to the change in target value, namely a phase delay, when symbol t1 denotes the follow-up time in the case of the new discharge electrode 21, symbol t2 denotes the follow-up time in the case of the discharge electrode 21 with moderate contamination, and symbol t3 denotes the follow-up time in the case of the discharge electrode 21 with serious contamination, the relation of $t1<t2<t3$ is established. In other words, the follow-up time t1 in the case of the new discharge electrode 21 is the shortest time, the follow-up time t3 in the case of the discharge electrode 21 with serious contamination is the longest time, and the follow-up time t2 in the case of the discharge electrode 21 with moderate contamination is the moderate length of time. That is, the follow-up time t increases with the progress of the contamination condition.

Continuously with reference to FIG. 27, as for a follow-up amplitude of the value of the detected FGIC, when symbol A1 denotes the follow-up amplitude in the case of the new discharge electrode 21, symbol A2 denotes the follow-up amplitude in the case of the discharge electrode 21 with moderate contamination, and symbol A3 denotes the follow-up amplitude in the case of the discharge electrode 21 with serious contamination, the relation of $A1>A2>A3$ is established. In other words, the follow-up amplitude A1 in the case of the new discharge electrode 21 is the largest, the follow-up amplitude A3 in the case of the discharge electrode 21 with serious contamination is the smallest, and the follow-up amplitude A2 in the case of the discharge electrode 21 with moderate contamination is moderate. That is, the follow-up amplitude A decreases with the progress of the contamination condition.

Continuously with reference to FIG. 27, as for a follow-up tilt angle of rising or falling of the value of the detected FGIC, when symbol θ1 denotes the follow-up tilt angle in the case of the new discharge electrode 21, symbol θ2 denotes the follow-up tilt angle in the case of the discharge electrode 21 with moderate contamination, and symbol θ3 denotes the follow-up tilt angle in the case of the discharge electrode 21 with serious contamination, the relation of $\theta 1<\theta 2<\theta 3$ is established. In other words, the follow-up tilt angle $\theta 1$ in the case of the new discharge electrode 21 is the smallest, the follow-up tilt angle $\theta 3$ in the case of the discharge electrode 21 with serious contamination is the largest, and the follow-up tilt angle $\theta 2$ in the case of the discharge electrode 21 with moderate contamination is moderate. That is, the follow-up tilt angle $\theta$ increases with the progress of the contamination condition.

Continuously with reference to FIG. 27, as for an integral value S of the value of the detected FGIC with respect to a reference value (zero, here) of the value of the detected FGIC for a prescribed time period, when symbol S1 denotes the integral value in the case of the new discharge electrode 21, symbol S2 denotes the integral value in the case of the discharge electrode 21 with moderate contamination, and symbol S3 denotes the integral value in the case of the discharge electrode 21 with serious contamination, the relation of S1>S2>S3 is established. In other words, the integral value S1 in the case of the new discharge electrode 21 is the largest, the integral value S3 in the case of the discharge electrode 21 with serious contamination is the smallest, and the integral value S2 in the case of the discharge electrode 21 with moderate contamination is moderate. That is, the integral value S decreases with the progress of the contamination condition.

Since the follow-up time (phase delay time) t, the follow-up amplitude A, the follow-up tilt angle $\theta$, and the integral value S vary depending on the contamination condition of the discharge electrode 21 as described above, performing sampling with every change in target value, regularly, or in an appropriate cycle, to make comparison with thresholds at a plurality of levels can divide the contamination condition of the discharge electrode 21 into, for example, five levels, so as to make these divided levels displayed by a display device 60 (FIG. 1) consisting of five LEDs provided in the static eliminator 1.

First to fifth thresholds added to FIG. 27 relate to the follow-up time t. When the follow-up time t is adopted for determining the contamination condition of the discharge electrode 21, the detected follow-up time t can be compared with the first to fifth thresholds to determine the contamination condition of the discharge electrode 21 and display the determined contamination condition by use of the display device 60.

Naturally, in the case of the follow-up amplitude A, the follow-up tilt angle $\theta$, and the integral value S, the contamination condition of the discharge electrode 21 can be determined by using the same practice. Further, two parameters, such as the follow-up time t and the follow-up amplitude A, may be used for determining the contamination condition of the discharge electrode 21. That is, the determination can be made by using parameters singly or in combination, values of the parameters varying depending on the contamination condition of the discharge electrode 21.

Figure 28:
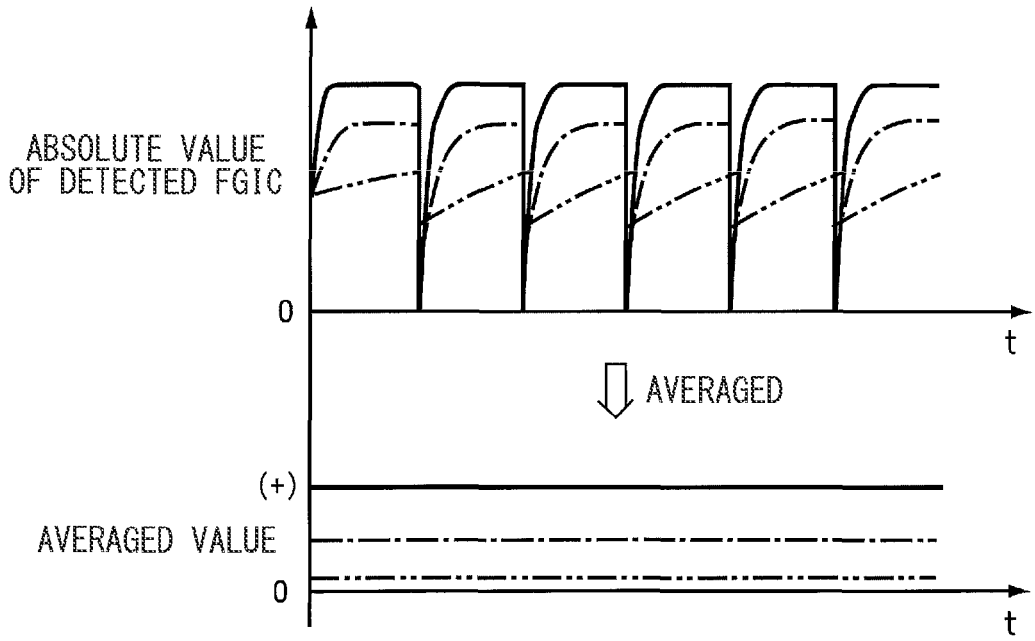
FIG. 28 is a diagram for explaining an example of determining the contamination condition of the discharge electrode in regard to a method for determining the contamination condition of the discharge electrode, where the detected frame ground current FGIC is replaced by an absolute value, which is averaged by a sufficiently slow LPF and then compared with thresholds at a plurality of levels for the determination.

Concerning the method for determining the contamination condition of the discharge electrode 21, as shown in FIG. 28, it is possible to replace the detected FGIC with, for example, an absolute value in terms of hardware, and compare a value obtained by averaging the absolute value by a sufficiently slow LPF with thresholds at a plurality of levels, so as to determine the contamination condition of the discharge electrode 21. In FIG. 28, a solid line indicates the case of the new discharge electrode 21, a dashed line indicates the case of the discharge electrode 21 with moderate contamination, and a chain double-dashed line indicates the case of the discharge electrode 21 with serious contamination.

Figure 29:
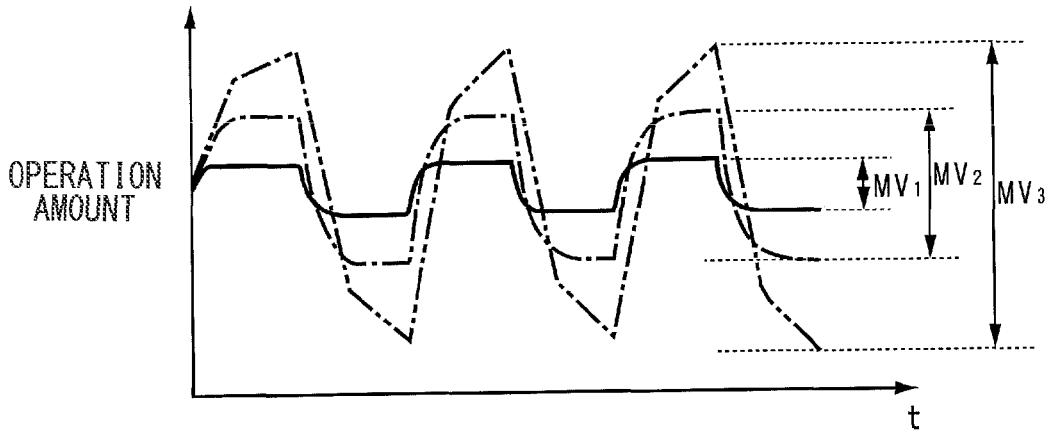
FIG. 29 is a diagram for explaining an example of determining contamination of the discharge electrode by means of the operation amount, where a solid line indicates the case of the new discharge electrode, a broken line indicates the case of the discharge electrode with moderate contamination, and a chain double-dashed line indicates the case of the discharge electrode with serious contamination.

Further, as shown in FIG. 29, the contamination condition of the discharge electrode 21 may be determined by means of an operation amount MV of Duty or a high voltage value. Symbol MV1 (solid line) denotes the operation amount in the case of the new discharge electrode 21, symbol MV2 (dashed line) denotes the operation amount in the case of the discharge electrode 21 with moderate contamination, and symbol MV3 (chain double-dashed line) denotes the operation amount in the case of the discharge electrode 21 with serious contamination. Since the operation amount MV increases with the progress of the contamination condition of the discharge electrode 21 as described above, it is possible to determine the contamination condition of the discharge electrode 21 by comparison with threshold at a plurality of levels.

Figure 30:
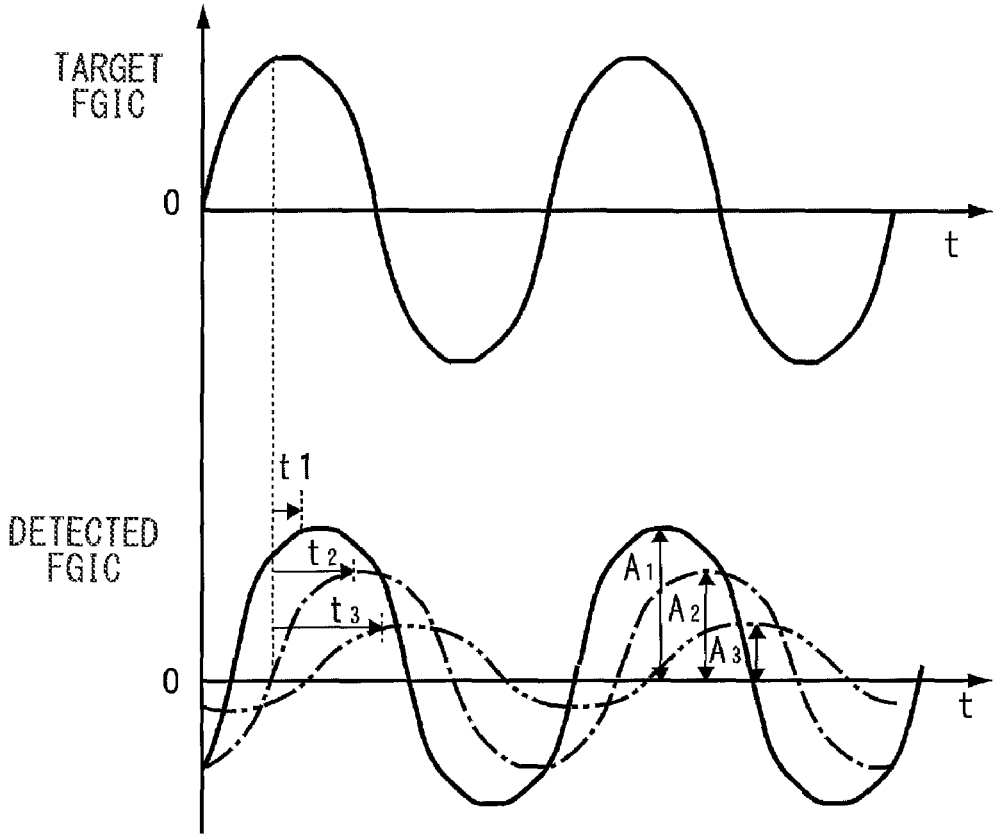
FIG. 30 is a waveform diagram showing a change in frame ground current FGIC in the case of changing the ion balance target value in sine wave form, where a solid line indicates the case of the new discharge electrode, a broken line indicates the case of the discharge electrode with moderate contamination, and a chain double-dashed line indicates the case of the discharge electrode with serious contamination.

FIG. 30 shows another specific example concerning the change in target value. As apparent by comparison with FIG. 26 where the target value is changed in rectangular pulse shape, in another specific example of FIG. 30, the ion balance target value is changed in sine wave shape (sin-wave shape). As for the detected frame ground current FGIC of FIG. 30, a solid line indicates the case of the new discharge electrode 21, a dashed line indicates the case of the discharge electrode 21 with moderate contamination, and a chain double-dashed line indicates the case of the discharge electrode 21 with serious contamination.

What is to be noted here is as follows: (1) the follow-up delay (phase difference) t varies depending on the contamination condition of the discharge electrode 21; (2) the amplitude varies depending on the contamination condition of the discharge electrode 21; and (3) the frequency varies depending on the contamination condition of the discharge electrode 21.

It is therefore possible to determine the contamination condition of the discharge electrode 21 by comparison with thresholds at a plurality of levels with the phase difference, amplitude or frequency used as a parameter. Further, since the operation amount also varies, analysis (FFT or the like) may be made on: (4) the amplitude of the operation amount (Duty or high voltage value); (5) the phase difference of the operation amount (Duty or high voltage value); or (6) frequency of the operation amount (Duty or high voltage value), to detect a variable frequency component, and thereby the contamination condition of the discharge electrode 21 may be determined.

Further, in determination of the discharge electrode 21, a single reference waveform pattern or a plurality of reference waveform patterns (current values of FGIC of the discharge electrodes 21 with different contamination conditions) may be stored in the memory, and the contamination condition of the discharge electrode 21 may be determined based on the reference waveform patterns. As for the reference waveform patterns as the basis of the determination, as described above, the reference waveform patterns such as waveforms of the detected frame ground current FGIC shown in FIG. 26 (new discharge electrode, and discharge electrodes with slight contamination, moderate contamination, serious contamination, and the most serious contamination) may be previously obtained by teaching, and then stored into the memory, and the contamination condition of the discharge electrode 21 may be determined by comparison with these reference waveform patterns.

Naturally, since the discharge electrode 21 and the contamination condition are correlative, only the reference waveform pattern taken as the basis may be stored into the memory, and based on a waveform pattern obtained by multiplying this reference waveform pattern by a prescribed coefficient, the contamination condition of the discharge electrode 21 may be determined.

As thus described, by changing the ion balance target value so as not to affect the ion balance in the vicinity of the workpiece, and then using a parameter that varies with the change in target value and its difference appears depending on the contamination condition of the discharge electrode 21, it is possible to determine the contamination condition of the discharge electrode 21.

What is claimed is:

1. A static eliminator, which applies a high voltage from a high voltage circuit to a discharge electrode to generate ions so as to eliminate static electricity of a workpiece, the eliminator comprising:

a resistor which is disposed between the high voltage circuit and a frame ground;

a filter circuit which receives a value from the resistor and outputs a detected frame ground current value;

an ion generation control device which receives the detected frame ground current value and adjusts at least one of a positive and negative voltage duty ratio and a voltage value to be applied to the discharge electrode such that the detected frame ground current value output from the filter circuit approaches a prescribed ion balance target value;

a target value change device which changes the ion balance target value to a target value offset to such a degree as not to affect the ion balance of the workpiece; and an electrode contamination detection device which detects contamination of the discharge electrode in accordance with the quality of follow-up performance of the frame ground current that is after the change in the target value when the ion balance target value is changed by the target value change device, wherein the follow-up performance in the case of the discharge electrode with contamination has a frame ground current value that is less than in the case of the discharge electrode without contamination.

2. The static eliminator according to claim 1, wherein the target value change device changes the ion balance target value from a prescribed reference value alternately to a plus side and a minus side.

3. The static eliminator according to claim 2, wherein the target value change device changes the ion balance target value into rectangular pulse shape.

4. The static eliminator claim 2, wherein the target value change device changes the ion balance target value into sine wave shape.

5. The static eliminator according to claim 1, wherein the ground electrode is buried in an insulating synthetic resin material in the bottom surface section of the static eliminator.

6. The static eliminator according to claim 1, further comprising a display device which displays an amount of contamination of the discharge electrode detected by the electrode contamination detection device.

7. The static eliminator according to claim 2, wherein the electrode contamination detection device detects the phase difference of the detected frame ground current value.

8. The static eliminator according to claim 2, wherein the electrode contamination detection device detects the amplitude of the detected frame ground current value.

9. The static eliminator according to claim 2, wherein the electrode contamination detection device detects the frequency of the detected frame ground current value.

10. The static eliminator according to claim 1, wherein the target value change device changes the ion balance target value to a target value offset to such a degree that the time required for a value of the frame ground current to follow up the change in target value is larger than a pulse period of a voltage to be applied to the discharge electrode.

11. The static eliminator according to claim 1, wherein the target value change device changes the ion balance target value into rectangular pulse shape.

12. The static eliminator claim 1, wherein the target value change device changes the ion balance target value into sine wave shape.

13. A static eliminator, which applies a high voltage from a high voltage circuit to a discharge electrode to generate ions so as to eliminate static electricity of a workpiece, the eliminator comprising:

a resistor which is disposed between the high voltage circuit and a frame ground;

a filter circuit which receives a value from the resistor and outputs a detected frame ground current value;

a target value change device which changes an ion balance target value to a target value offset to such a degree that the time required for the detected frame ground current value to follow up a change in the target value is larger than a pulse period of a voltage to be applied to the discharge electrode; and an ion generation control device which receives the detected frame ground current value and adjusts at least one of a positive and negative voltage duty ratio and a voltage value to be applied to the discharge electrode such that the detected frame ground current value output from the filter circuit approaches a prescribed ion balance target value.

14. A static eliminator, which applies a high voltage from a high voltage circuit to a discharge electrode to generate ions so as to eliminate static electricity of a workpiece, the eliminator comprising:

a resistor which is disposed between the high voltage circuit and a frame ground;

a filter circuit which receives a value from the resistor and outputs a detected frame ground current value;

a target value change device which changes an ion balance target value to a target value of at least ±10V; and an ion generation control device which receives the detected frame ground current value and adjusts at least one of a positive and negative voltage duty ratio and a voltage value to be applied to the discharge electrode such that the detected frame ground current value output from the filter circuit approaches a prescribed ion balance target value.

15. A static eliminator, which applies a high voltage from a high voltage circuit to a discharge electrode to generate ions so as to eliminate static electricity of a workpiece, the eliminator comprising:

a resistor which is disposed between the high voltage circuit and a frame ground;

a filter circuit which receives a value from the resistor and outputs a detected frame ground current value;

a target value change device which changes an ion balance target value to a target value of at least ±10V;

an ion generation control device which receives the detected frame ground current value and adjusts at least one of a positive and negative voltage duty ratio and a voltage value to be applied to the discharge electrode such that the detected frame ground current value output from the filter circuit approaches a prescribed ion balance target value; and an electrode contamination detection device which compares a detected frame ground current value to predetermined frame ground current values by comparing to known values of at least one of frequency, amplitude and phase difference.

* * * * *